US010407892B2

(12) United States Patent
Hohmann, Jr.

(10) Patent No.: US 10,407,892 B2
(45) **Date of Patent: *Sep. 10, 2019**

(54) HIGH-STRENGTH PARTITION TOP ANCHOR AND ANCHORING SYSTEM UTILIZING THE SAME

(71) Applicant: Columbia Insurance Company, Omaha, NE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/857,736

(22) Filed: Sep. 17, 2015

(65) Prior Publication Data

US 2017/0081838 A1 Mar. 23, 2017

(51) Int. Cl.

| | |
|---|---|
| ***E04B 1/04*** | (2006.01) |
| ***E04B 1/41*** | (2006.01) |
| *E04H 9/14* | (2006.01) |

(52) U.S. Cl.

CPC ..... *E04B 1/043* (2013.01); *E04B 1/4107* (2013.01); *E04B 1/4178* (2013.01)

(58) Field of Classification Search

CPC ..... E04B 1/043; E04B 1/41; E04B 1/4121; E04H 9/14

USPC ..... 52/272, 704, 706, 707, 710

See application file for complete search history.

(56) References Cited

U.S. PATENT DOCUMENTS

| | | | | |
|---|---|---|---|---|
| D26,027 | S | 9/1896 | von Heyderbrand | |
| 819,869 | A | 5/1906 | Dunlap | |
| 903,000 | A | 11/1908 | Priest, Jr. | |
| 1,014,157 | A | 1/1912 | Lewen | |
| 1,170,419 | A | 2/1916 | Coon et al. | |
| D56,118 | S | 8/1920 | Chance | |
| 1,359,978 | A * | 11/1920 | Folin | E04B 1/4107 256/65.02 |
| 1,392,703 | A | 10/1921 | Phillips | |
| RE15,979 | E | 1/1925 | Schaefer et al. | |
| 1,541,518 | A | 6/1925 | McCain | |

(Continued)

FOREIGN PATENT DOCUMENTS

| | | |
|---|---|---|
| CA | 2502978 | 1/2009 |
| CH | 279209 | 11/1951 |

(Continued)

OTHER PUBLICATIONS

Canadian Examination Report from CA 2,845,330, dated Apr. 6, 2016, 4 pages.

(Continued)

*Primary Examiner* — Patrick J Maestri
*Assistant Examiner* — Joseph J Sadlon
(74) *Attorney, Agent, or Firm* — Stinson LLP

(57) ABSTRACT

A high-strength partition top anchor and anchoring system is disclosed. The high-strength partition top anchor is a dynamic anchor that provides resistance to wall and deck separation during periods of high lateral forces. The partition top anchor is set within a slip tube embedded within the upper most portion of a partition or masonry wall and interconnected with a channel affixed to an overlying slab or deck structure.

21 Claims, 47 Drawing Sheets

(56) References Cited

U.S. PATENT DOCUMENTS 1,621,877 A * 3/1927 Fitzgerald ..... E04F 19/06 52/704
1,714,411 A 5/1929 Walter
1,794,684 A 3/1931 Handel
1,854,633 A 4/1932 Stephens
1,936,223 A 11/1933 Awbrey
1,942,863 A 1/1934 Johnstone
1,988,124 A 1/1935 Johnson
2,058,148 A 10/1936 Hard
2,097,821 A 11/1937 Mathers
2,121,213 A * 6/1938 Small ..... E04F 19/06 52/127.12
2,130,531 A 9/1938 Arand
2,240,117 A 4/1941 Homolya
2,280,647 A 4/1942 Hawes
2,300,181 A 10/1942 Spaight
2,343,764 A 3/1944 Fuller
2,363,156 A * 11/1944 Sinner ..... E04H 13/003 52/378
2,403,566 A 7/1946 Thorp et al.
2,413,772 A 1/1947 Morehouse
2,605,867 A 8/1952 Goodwin
2,625,357 A 1/1953 Atkinson
2,631,488 A 3/1953 Tansey
2,780,936 A 2/1957 Hillberg
2,798,404 A 7/1957 Schaefer et al.
2,898,758 A 8/1959 Henrickson
2,909,054 A * 10/1959 Phillips ..... E04B 1/4107 52/710
2,929,238 A 3/1960 Kaye
2,936,667 A 5/1960 Thorberg
D188,679 S 8/1960 D'Atri
2,948,045 A 8/1960 Imonetti
2,966,705 A 1/1961 Massey
2,999,571 A 9/1961 Huber
3,030,670 A 4/1962 Bigelow
3,088,361 A 5/1963 Hallock
3,114,220 A 12/1963 Maddox et al.
3,121,978 A * 2/1964 Reiland ..... E04B 1/4107 52/370
3,183,628 A 5/1965 Smith
3,254,736 A 6/1966 Gass
3,277,626 A 10/1966 Brynjolfsson et al.
3,292,336 A 12/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,342,005 A 9/1967 Rickards et al.
3,353,312 A 11/1967 Starch
3,377,764 A 4/1968 Storch
3,380,208 A * 4/1968 Cook ..... E04B 5/48 16/108
3,440,922 A 4/1969 Cohen
3,478,409 A 11/1969 Votaw et al.
3,478,480 A 11/1969 Swenson
3,494,090 A 2/1970 Allen
3,500,713 A 3/1970 Bell
3,523,395 A 4/1970 Rutter et al.
D218,017 S 7/1970 Brown
3,529,508 A 9/1970 Cooksey
3,563,131 A 2/1971 Ridley, Sr.
3,568,389 A 3/1971 Gulow
3,587,198 A 6/1971 Hensel
3,606,236 A * 9/1971 Seegers ..... B28B 7/0029 249/14
3,621,626 A * 11/1971 Tylius ..... E04B 1/043 403/363
3,628,299 A * 12/1971 Nakazawa ..... E04B 1/4107 52/506.06
3,640,043 A 2/1972 Querfeld et al.
3,707,815 A 1/1973 Molyneux
3,760,542 A * 9/1973 Haeussler ..... E04F 13/007 52/235
D229,538 S 12/1973 Steffan
3,786,605 A 1/1974 Winfrey
3,803,972 A 4/1974 Deutsher
3,890,758 A * 6/1975 Bouchard ..... E04B 1/4128 248/650
3,893,274 A * 7/1975 Salisbury ..... E04B 1/4157 411/349
3,897,712 A 8/1975 Black
3,911,783 A 10/1975 Gapp et al.
3,925,996 A 12/1975 Wiggill
3,938,545 A * 2/1976 Nagy ..... E02D 29/14 137/363
3,964,226 A 6/1976 Hala et al.
3,964,227 A 6/1976 Hala
4,002,001 A 1/1977 Uydess
4,021,990 A 5/1977 Schwalberg
4,040,228 A * 8/1977 Skubic ..... E04B 1/4107 411/302
4,060,951 A 12/1977 Gere
4,087,947 A * 5/1978 Turner ..... E04G 15/04 294/90
4,107,890 A 8/1978 Seghezzi et al.
4,108,560 A 8/1978 Minogue
4,130,977 A * 12/1978 Taylor, Jr. ..... E04G 15/061 52/710
4,227,359 A 10/1980 Schlenker
4,238,987 A 12/1980 Siebrecht-Reuter
D259,171 S 5/1981 Wallace
4,281,494 A 8/1981 Weinar
4,305,239 A 12/1981 Geraghty
D264,125 S 4/1982 Biggs
4,329,823 A 5/1982 Simpson
4,350,464 A 9/1982 Brothers
4,367,892 A * 1/1983 Holt ..... B66C 1/666 294/82.31
4,373,314 A 2/1983 Allan
4,382,416 A 5/1983 Kellogg-Smith
4,398,322 A 8/1983 Ewen
4,410,760 A 10/1983 Cole
4,422,617 A 12/1983 Gallis
4,424,745 A 1/1984 Magorian et al.
4,426,061 A 1/1984 Taggart
4,430,035 A 2/1984 Rodseth
4,438,611 A 3/1984 Bryant
4,460,300 A 7/1984 Bettini et al.
4,473,209 A 9/1984 Gallis et al.
4,473,984 A 10/1984 Lopez
4,482,368 A 11/1984 Roberts
4,484,422 A 11/1984 Roberts
4,498,271 A * 2/1985 Koniger ..... E04B 1/41 33/518
4,523,413 A 6/1985 Koppenberg
4,571,909 A 2/1986 Berghuis et al.
4,596,102 A 6/1986 Catani et al.
4,598,518 A 7/1986 Hohmann
4,600,344 A 7/1986 Sutenbach et al.
4,604,003 A * 8/1986 Francoeur ..... E02D 5/523 29/452
4,606,163 A 8/1986 Catani
4,622,796 A 11/1986 Aziz et al.
4,628,657 A 12/1986 Ermer et al.
4,631,889 A * 12/1986 Adam ..... E04G 23/0222 52/565
4,636,125 A 1/1987 Burgard
4,640,848 A 2/1987 Cerdan-Diaz et al.
4,653,244 A 3/1987 Farrell
4,656,806 A * 4/1987 Leibhard ..... F16B 13/065 411/15
4,660,342 A 4/1987 Salisbury
4,680,913 A 7/1987 Geisen et al.
4,688,363 A 8/1987 Sweeney et al.
4,703,604 A 11/1987 Muller
4,708,551 A * 11/1987 Richter ..... E04F 13/0837 411/32
4,714,507 A 12/1987 Ohgushi
4,723,866 A 2/1988 McCauley
4,736,554 A 4/1988 Tyler
4,738,070 A 4/1988 Abbott et al.

(56) References Cited

U.S. PATENT DOCUMENTS 4,742,659 A 5/1988 Meilleur
4,757,662 A 7/1988 Gasser
4,764,069 A 8/1988 Reinwall et al.
4,815,895 A * 3/1989 Purssey ..... E04B 1/04 138/155
4,819,401 A 4/1989 Whitney, Jr.
4,825,614 A 5/1989 Bennett et al.
4,827,684 A 5/1989 Allan
4,843,776 A 7/1989 Guignard
4,852,320 A 8/1989 Ballantyne
4,861,197 A * 8/1989 Calandra, Jr. ..... E21D 21/0026 405/259.3
4,869,038 A 9/1989 Catani
4,869,043 A 9/1989 Hatzinikolas et al.
4,875,319 A 10/1989 Hohmann
4,887,951 A 12/1989 Hashimoto
4,911,949 A 3/1990 Iwase et al.
4,922,680 A 5/1990 Kramer et al.
4,923,348 A 5/1990 Carlozzo et al.
4,946,632 A 8/1990 Pollina
4,948,319 A 8/1990 Day et al.
4,955,172 A 9/1990 Pierson
4,970,842 A 11/1990 Kappeler et al.
4,993,902 A 2/1991 Hellon
5,012,624 A 5/1991 Dahlgren
5,016,855 A 5/1991 Huggins
5,063,722 A 11/1991 Hohmann
5,099,628 A 3/1992 Noland et al.
D326,809 S 6/1992 Paul
5,169,114 A * 12/1992 O'Neill ..... E05B 73/0082 248/316.4
5,207,043 A 5/1993 McGee et al.
5,209,619 A 5/1993 Rinderer
D336,844 S 6/1993 Hozapfel et al.
5,243,805 A * 9/1993 Fricker ..... E04B 1/41 52/698
5,307,602 A 5/1994 Lebraut
5,338,141 A 8/1994 Hulsey
5,347,781 A 9/1994 Hanlon
5,392,581 A 2/1995 Hatzinikolas et al.
5,395,196 A 3/1995 Notaro
5,408,798 A 4/1995 Hohmann
5,433,569 A 7/1995 Fall et al.
5,439,338 A 8/1995 Rosenberg
5,440,854 A 8/1995 Hohmann
5,454,200 A 10/1995 Hohmann
5,456,052 A 10/1995 Anderson et al.
5,490,366 A 2/1996 Burns et al.
5,501,306 A 3/1996 Martino
5,518,351 A 5/1996 Peil
D373,623 S 9/1996 Mathison
5,562,377 A * 10/1996 Giannuzzi ..... F16B 13/141 405/259.5
5,598,673 A 2/1997 Atkins
5,623,804 A * 4/1997 Kelly ..... E04B 1/4107 52/704
5,634,310 A 6/1997 Hohmann
5,638,584 A 6/1997 De Anfrasio
5,644,889 A 7/1997 Getz
5,655,349 A * 8/1997 Ghali ..... E04B 5/43 52/334
5,669,592 A 9/1997 Kearful
5,671,578 A 9/1997 Hohmann
5,673,527 A 10/1997 Coston et al.
RE35,659 E 11/1997 Ernst et al.
5,755,070 A 5/1998 Hohmann
D397,401 S 8/1998 Diederich
5,806,275 A 9/1998 Giannuzzi et al.
5,816,008 A 10/1998 Hohmann
5,819,486 A 10/1998 Goodings
5,836,126 A 11/1998 Harkenrider et al.
5,845,455 A 12/1998 Johnson, III
D406,524 S 3/1999 Steenson et al.
5,953,865 A 9/1999 Rickards
D417,139 S 11/1999 Pitre
6,000,178 A 12/1999 Goodings
6,009,677 A * 1/2000 Anderson ..... E04B 1/043 52/236.6
6,033,153 A * 3/2000 Fergusson ..... E21D 20/02 405/259.1
D426,766 S 6/2000 Burchall et al.
6,098,364 A 8/2000 Liu
6,125,608 A 10/2000 Charlson
6,128,883 A 10/2000 Hatzinikolas
6,131,360 A 10/2000 Dalen
6,138,941 A 10/2000 Miyake
6,176,662 B1 1/2001 Champney et al.
D438,494 S 3/2001 Charmat et al.
6,209,281 B1 4/2001 Rice
6,279,283 B1 8/2001 Hohmann et al.
6,284,311 B1 9/2001 Gregorovich et al.
6,293,744 B1 9/2001 Hempfling et al.
6,332,300 B1 12/2001 Wakai
6,341,452 B1 * 1/2002 Bollinghaus ..... E04G 15/04 249/175
6,345,472 B1 2/2002 Taylor
D454,773 S 3/2002 Gilbert et al.
6,351,922 B1 3/2002 Burns et al.
D455,330 S 4/2002 Gilbert et al.
D455,945 S 4/2002 Gilbert et al.
6,367,219 B1 4/2002 Quinlan
6,401,406 B1 6/2002 Komara
6,449,914 B1 * 9/2002 Horstketter ..... E01D 19/125 52/251
6,502,362 B1 1/2003 Zambelli et al.
6,508,447 B1 1/2003 Catani et al.
6,511,522 B1 * 1/2003 Gomez ..... E04B 9/02 454/187
6,548,190 B2 4/2003 Spitsberg et al.
6,612,343 B2 9/2003 Camberlin et al.
6,627,128 B1 9/2003 Boyer
6,668,505 B1 12/2003 Hohmann et al.
6,686,301 B2 2/2004 Li et al.
6,709,213 B2 3/2004 Bailey
6,718,774 B2 4/2004 Razzell
6,735,915 B1 5/2004 Johnson, III
6,739,105 B2 5/2004 Fleming
6,763,640 B2 7/2004 Lane
6,789,365 B1 9/2004 Hohmann et al.
6,802,675 B2 10/2004 Timmons et al.
D499,010 S 11/2004 Velten
6,812,276 B2 11/2004 Yeager
6,817,147 B1 11/2004 MacDonald
6,817,156 B2 * 11/2004 Mok ..... E04B 1/4107 52/677
6,827,969 B1 12/2004 Skoog et al.
6,837,013 B2 1/2005 Foderberg et al.
6,851,239 B1 2/2005 Hohmann et al.
6,918,218 B2 7/2005 Greenway
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,044,426 B1 * 5/2006 Allmon ..... E04H 9/02 248/499
7,059,577 B1 6/2006 Burgett
D527,834 S 9/2006 Thimons et al.
D530,796 S 10/2006 Zielke et al.
7,114,900 B2 10/2006 Toosky
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,237,368 B2 * 7/2007 Richardson ..... E04B 1/4107 52/295
7,325,366 B1 2/2008 Hohmann, Jr. et al.
7,334,374 B2 2/2008 Schmid
D568,729 S 5/2008 Gary

(56) References Cited

U.S. PATENT DOCUMENTS 7,374,825 B2 5/2008 Hazel et al.
7,404,274 B2 7/2008 Hayes
7,415,803 B2 8/2008 Bronner
7,421,826 B2 9/2008 Collins et al.
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,596,917 B2 * 10/2009 Schloemer ..... E04B 1/762 52/258
D603,251 S 11/2009 King
7,617,649 B2 * 11/2009 Arakawa ..... A47F 5/0006 248/317
D605,500 S 12/2009 Lee et al.
7,654,057 B2 2/2010 Zambelli et al.
7,677,832 B2 * 3/2010 Yee ..... F16L 13/113 404/40
7,698,861 B2 * 4/2010 Bogue ..... E04C 5/02 52/379
D615,392 S 5/2010 Gaudron et al.
7,717,015 B2 5/2010 Nilsen et al.
D618,088 S 6/2010 Gaylor
7,735,292 B2 6/2010 Massie
7,744,321 B2 6/2010 Wells
7,748,181 B1 7/2010 Guinn
7,779,581 B2 * 8/2010 Flaherty ..... E01C 5/20 116/205
7,784,240 B2 * 8/2010 Miller ..... E04F 19/02 256/65.01
7,788,869 B2 9/2010 Voegele, Jr.
D625,977 S 10/2010 Watson et al.
D626,817 S 11/2010 Donowho et al.
7,845,137 B2 12/2010 Hohmann, Jr.
D630,500 S 1/2011 van Groesen
D631,736 S 2/2011 You
7,918,634 B2 4/2011 Conrad et al.
8,015,757 B1 9/2011 Hohmann, Jr.
8,029,223 B2 10/2011 Mair
8,037,653 B2 10/2011 Hohmann, Jr.
8,046,956 B1 11/2011 Hohmann, Jr.
8,051,619 B2 11/2011 Hohmann, Jr.
8,092,134 B2 1/2012 Oguri et al.
8,096,090 B1 1/2012 Hohmann, Jr. et al.
8,109,706 B2 2/2012 Richards
8,122,663 B1 2/2012 Hohmann, Jr. et al.
8,132,389 B2 * 3/2012 Gee ..... B28B 23/005 52/699
8,154,859 B2 4/2012 Shahrokhi
8,201,374 B2 6/2012 Hohmann, Jr.
8,209,934 B2 7/2012 Pettingale
8,215,083 B2 7/2012 Toas et al.
8,291,672 B2 10/2012 Hohmann, Jr. et al.
D672,639 S 12/2012 Pawluk
8,347,581 B2 1/2013 Doerr et al.
8,375,667 B2 2/2013 Hohmann, Jr.
8,397,467 B2 * 3/2013 Krell ..... E04B 1/4107 52/253
8,418,422 B2 4/2013 Johnson, III
8,468,765 B1 6/2013 Kim
8,490,363 B2 * 7/2013 Nagy ..... E04B 1/04 52/250
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,561,366 B2 * 10/2013 Gasperi ..... E04B 1/4107 52/235
8,596,010 B2 12/2013 Hohmann, Jr.
8,609,224 B2 12/2013 Li et al.
8,613,175 B2 12/2013 Hohmann, Jr.
8,635,832 B2 1/2014 Heudorfer et al.
D698,634 S 2/2014 Oetlinger
D699,555 S 2/2014 Yazich
8,661,741 B2 3/2014 Hohmann, Jr.
8,661,766 B2 3/2014 Hohmann, Jr.
8,667,757 B1 3/2014 Hohmann, Jr.
8,726,596 B2 5/2014 Hohmann, Jr.
8,726,597 B2 5/2014 Hohmann, Jr.
8,733,049 B2 5/2014 Hohmann, Jr.
8,739,485 B2 6/2014 Hohmann, Jr.
8,800,241 B2 8/2014 Hohmann, Jr.
8,807,877 B1 * 8/2014 Fox ..... E21D 21/0026 405/259.1
8,833,003 B1 9/2014 Hohmann, Jr.
8,839,581 B2 9/2014 Hohmann, Jr.
8,839,587 B2 9/2014 Hohmann, Jr.
8,844,229 B1 9/2014 Hohmann, Jr.
8,863,460 B2 10/2014 Hohmann, Jr.
8,881,488 B2 11/2014 Hohmann, Jr. et al.
8,898,980 B2 12/2014 Hohmann, Jr.
8,904,726 B1 12/2014 Hohmann, Jr.
8,904,727 B1 12/2014 Hohmann, Jr.
8,904,730 B2 12/2014 Hohmann, Jr.
8,904,731 B2 12/2014 Hohmann, Jr. et al.
8,910,445 B2 12/2014 Hohmann, Jr.
8,920,092 B2 12/2014 D'Addario et al.
8,978,326 B2 3/2015 Hohmann, Jr.
8,978,330 B2 3/2015 Hohmann, Jr.
8,984,837 B2 3/2015 Curtis et al.
9,038,351 B2 3/2015 Hohmann, Jr.
9,127,449 B2 * 9/2015 Clear ..... E04B 1/165
9,273,460 B2 3/2016 Hohmann, Jr.
9,273,461 B1 3/2016 Hohmann, Jr.
9,273,714 B2 * 3/2016 Jackson ..... E01D 19/103
9,316,004 B1 * 4/2016 Hatzinikolas ..... F16M 13/02
D756,762 S 5/2016 Hohmann, Jr.
D759,462 S 6/2016 Bransgrove
D761,095 S 7/2016 van der Hoeff et al.
D766,069 S 9/2016 Miller
9,482,003 B2 * 11/2016 Browning ..... E04C 1/41
9,523,197 B2 12/2016 Sessler et al.
9,702,154 B2 * 7/2017 Wessendorf ..... E04G 5/046
D809,906 S 2/2018 Legault et al.
10,047,516 B2 * 8/2018 Espinosa ..... E04G 15/04 249/175
10,047,776 B2 * 8/2018 Hettich ..... E04G 15/04 294/90
2001/0054270 A1 12/2001 Rice
2002/0047488 A1 4/2002 Webb et al.
2002/0100239 A1 8/2002 Lopez
2003/0121226 A1 7/2003 Bolduc
2003/0208968 A1 * 11/2003 Lancelot, III ..... E04G 21/142 52/125.4
2003/0217521 A1 11/2003 Richardson et al.
2004/0003558 A1 1/2004 Collins et al.
2004/0083667 A1 5/2004 Johnson, III
2004/0187421 A1 9/2004 Johnson, III
2004/0216408 A1 11/2004 Hohmann, Jr.
2004/0216413 A1 11/2004 Hohmann et al.
2004/0216416 A1 11/2004 Hohmann et al.
2004/0231270 A1 11/2004 Collins et al.
2005/0046187 A1 3/2005 Takeuchi et al.
2005/0129485 A1 6/2005 Swim, Jr.
2005/0183382 A1 8/2005 Jesen et al.
2005/0279042 A1 12/2005 Bronner
2005/0279043 A1 12/2005 Bronner
2006/0005490 A1 1/2006 Hohmann, Jr.
2006/0198717 A1 9/2006 Fuest
2006/0242921 A1 11/2006 Massie
2006/0251916 A1 11/2006 Arikawa et al.
2007/0011964 A1 1/2007 Smith
2007/0039281 A1 2/2007 Zambelli et al.
2007/0059121 A1 3/2007 Chien
2008/0092472 A1 4/2008 Doerr et al.
2008/0141605 A1 6/2008 Hohmann
2008/0166203 A1 7/2008 Reynolds et al.
2008/0222992 A1 9/2008 Hikai et al.
2009/0003970 A1 1/2009 Griffith
2009/0133351 A1 5/2009 Wobber
2009/0133357 A1 5/2009 Richards

(56) References Cited

U.S. PATENT DOCUMENTS

| | | | | |
|---|---|---|---|---|
| 2009/0173828 | A1 | 7/2009 | Oguri et al. | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0164943 | A1 | 7/2011 | Conrad et al. | |
| 2011/0173902 | A1 | 7/2011 | Hohmann, Jr. et al. | |
| 2011/0189480 | A1 | 8/2011 | Hung | |
| 2011/0277397 | A1 | 11/2011 | Hohmann, Jr. | |
| 2011/0301652 | A1 | 12/2011 | Reed et al. | |
| 2012/0011793 | A1 | 1/2012 | Clark et al. | |
| 2012/0037582 | A1 | 2/2012 | Wang | |
| 2012/0186183 | A1 | 7/2012 | Johnson, III | |
| 2012/0285111 | A1 | 11/2012 | Johnson, III | |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 | 3/2013 | Hohmann, Jr. | |
| 2013/0074442 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0280013 | A1 | 10/2013 | Gong et al. | |
| 2013/0340378 | A1 | 12/2013 | Hohmann, Jr. | |
| 2014/0000211 | A1 | 1/2014 | Hohmann, Jr. | |
| 2014/0075855 | A1 | 3/2014 | Hohmann, Jr. | |
| 2014/0075856 | A1 | 3/2014 | Hohmann, Jr. | |
| 2014/0075879 | A1 | 3/2014 | Hohmann, Jr. | |
| 2014/0096466 | A1 | 4/2014 | Hohmann, Jr. | |
| 2014/0174013 | A1 | 6/2014 | Hohmann, Jr. et al. | |
| 2014/0202098 | A1 | 7/2014 | De Smet et al. | |
| 2014/0215958 | A1 | 8/2014 | Duyvejonck et al. | |
| 2014/0250826 | A1 | 9/2014 | Hohmann, Jr. | |
| 2014/0260065 | A1 | 9/2014 | Hohmann, Jr. | |
| 2014/0318074 | A1* | 10/2014 | Heudorfer | E04B 1/4107 52/710 |
| 2014/0345208 | A1 | 11/2014 | Hohmann, Jr. | |
| 2015/0033651 | A1 | 2/2015 | Hohmann, Jr. | |
| 2015/0096243 | A1 | 4/2015 | Hohmann, Jr. | |
| 2015/0121792 | A1 | 5/2015 | Spoo et al. | |
| 2016/0069066 | A1* | 3/2016 | Connell | F16B 5/0225 52/701 |
| 2016/0160493 | A1 | 6/2016 | Hohmann, Jr. | |
| 2017/0045068 | A1 | 2/2017 | Sikorski | |
| 2017/0081838 | A1 | 3/2017 | Hohmann, Jr. | |
| 2017/0159285 | A1 | 6/2017 | Hohmann, Jr. | |
| 2017/0350117 | A1* | 12/2017 | Hogan | E04B 2/90 |
| 2017/0356177 | A1 | 12/2017 | Lee | |
| 2018/0216338 | A1 | 8/2018 | Stroissnigg et al. | |

FOREIGN PATENT DOCUMENTS

| | | | | |
|---|---|---|---|---|
| DE | 231696 | | 6/1909 | |
| DE | 1960453 | | 6/1970 | |
| DE | 2856205 | A1 | 7/1980 | |
| EP | 0 199 595 | B1 | 3/1995 | |
| GB | 1 575 501 | | 9/1980 | |
| GB | 2 069 024 | A | 8/1981 | |
| GB | 2 246 149 | A | 1/1992 | |
| GB | 2 265 164 | A | 9/1993 | |
| GB | 2459936 | B | 3/2013 | |
| WO | WO 0166962 | A1 * | 9/2001 | F16B 13/124 |
| WO | 2006094362 | | 9/2006 | |
| WO | WO 2011123873 | A2 * | 10/2011 | E04B 1/043 |

OTHER PUBLICATIONS

Hohmann & Barnard, Inc., "Design and Fabrication of Stone Support and Masonry Anchor Systems", Product catalog, p. A20, 2007.

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Building Code Requirements for Masonry Structures and Commentary, TMS 402-11/ACI 530-11/ASCE 5-11, 2011, Chapter 6, 12 pages.

Hohmann & Barnard, Inc., Product Catalog, 44 pgs (2003).

Hohmann & Barnard, Inc.; Product Catalog, 2009, 52 pages, Hauppauge, New York, United States.

Hohmann & Barnard, Inc., Product Catalog, 2013, 52 pages, Hauppauge, New York, United States.

Kossecka, PH.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

ASTM WK 2748, Leakage Air Barrier Assemblies, Jan. 2005.

Heckmann Building Products, Inc. Pos-I-Tie Air Infiltration and Water Penetration Test, Aug. 2003. htt;://www.heckmannbuildingprods.com/PPosTest.htm.

Heckmann Building Products, Inc. "Wing Nut Pos-I-Tie" Product Catalogue Sheet, Melrose Park, IL, known as of Sep. 3, 2008.

www.heckmanbuildingprods.com, Heckman General Catalog for 2006, Oct. 28, 2006 pp. 4-5.

Wire Bond Corp, "Wire-Bond Sure Tie" and "Wire-Bond Clip". Product Catalog Sheet, Charlotte, NC, known as of Sep. 3, 2008.

Non-Final Office action/Restriction Requirement, U.S. Appl. No. 29/539,856, dated May 16, 2018, 8 pgs.

Canadian Examiner's Report, Application No. 2,936,124, dated Jul. 25, 2018, 5 pages.

Office action, U.S. Appl. No. 29/539,856, dated Aug. 21, 2018, 8 pages.

Non-Final Office Action, U.S. Appl. No. 29/655,780, dated May 10, 2019, pp. 7.

* cited by examiner

HIGH-STRENGTH PARTITION TOP ANCHOR AND ANCHORING SYSTEM UTILIZING THE SAME

BACKGROUND OF THE INVENTION

Field of the Invention

This invention relates to an improved anchoring arrangement for use in conjunction with building construction having an overlying concrete slab, concrete deck, or steel frame structure secured to the upper limits of a partition or masonry wall. More particularly, the invention relates to construction accessory devices, namely, high-strength partition top anchors set within a slip tube embedded in the uppermost portion of the wall and interconnected with the overlying structure. The invention is applicable to structures subjected to high lateral forces. The entirety of U.S. application Ser. No. 13/797,102, filed Mar. 12, 2013, issued as U.S. Pat. No. 8,978,326 on Mar. 17, 2015, is hereby incorporated by reference.

Description of the Prior Art

In the past, investigations relating to the effects of various forces, particularly high lateral loads or forces, upon structures located in areas subject to hurricanes, tornados, earthquakes and related destructive natural occurrences, demonstrated the advantages of having high-strength anchoring components interconnecting the vertical wall with the overlying slab or deck structure. The present invention improves on the prior art partition anchoring systems.

Anchoring systems for wall construction come in varied forms depending on the wall materials and structural use. Ronald P. Hohmann and Hohmann & Barnard, Inc., now a MiTek-Berkshire Hathaway company, have successfully commercialized numerous devices to secure wall structures to overlying structures, providing widespread improvements that include increases in interconnection strength, ease of manufacture and use, and thermal isolation. The present invention is an improvement in interconnection strength and lateral force reduction between the vertical wall and the overlying horizontal structure.

Earthquakes, strong storms, hurricanes, typhoons, tornadoes and the lateral forces that they create are devastating to building structures. In the United States, like many other countries, wind damage to building structures amounts to millions of dollars each year in losses. Many houses and other small buildings in the Caribbean hurricane zone can lose their roofs to category 3 and 4 storms under current construction methods. Structural weaknesses occur at the tie-down of the overlying structure to the walls. Current construction methods often fail to withstand hurricane uplift forces without separation of the overlying structure from the walls. A properly designed and anchored building can resist such damage through the use of the present partition top anchor. A properly constructed building structure must be designed to resist both vertical loads (loads acting in an up and down direction) and lateral loads (loads acting in a direction parallel to the ground).

The primary focus of this invention is to protect against high lateral load forces. The two major lateral load forces result from high winds, such as those from a hurricane, and seismic forces, such as those resulting from an earthquake. Wind and seismic forces can occur from any direction and the structure must be designed to withstand such forces. Each major building component and connection between each component must be constructed so each has the capacity to resist all the loads and transfer such loads between them and into the foundation. This transfer of loads is known as the load path.

Lateral loads are either transferred into the overlying structure, when wind pushes against the walls perpendicular to the wind, or they originate directly in the overlying structure during seismic activity. To withstand such lateral loads, the structure must be engineered to provide an acceptable level of structural integrity so that life-safety is assured and structural damage is minimized. Much of the structural damage caused by high lateral loads occurs at a weak link in the structure—the juncture of the horizontal overlying structure with the vertical support structures. The present invention is focused upon this juncture.

Static connections such as those presented in Argay, et al., U.S. Pat. No. 6,058,669 and Ramirez, U.S. Pat. No. 5,782,048, between the horizontal and vertical component of a structure often result in the separation of the components during prolonged periods of high lateral loads. As a result, dynamic partition top anchors, where the anchor is set in a slip tube embedded within the vertical wall are utilized for construction of structures that will be subjected to high lateral loads. The dynamic partition top anchor is interconnected along a slot or channel in the overlying structure and permitted to adjust in vertical and horizontal directions during times of high lateral load forces, allowing deflection of the overlying structure above the wall without transferring compressive loads.

Prior art partition top anchors are designed as a combination of a steel rod and attachment welded dovetail head. Such design locates the welded connection portion outside the connecting channel, thereby subjecting the weld between the rod and dovetail head to high levels of lateral load forces. The high level load forces at the weld point result in structural failure and separation of the rod and dovetail head removing the anchored connection. The present invention improves the prior art design by reengineering the dovetail head as an integral component of the rod structure, bonding the dovetail head within the rod, thereby providing a high-strength welded connection. Further, the welded interconnection is fully set within the channel, thereby redirecting the lateral forces to the high-strength steel rod and away from the welded connection. The present invention provides greater protection against anchor separation and structural strength than the prior art designs.

None of the above prior art anchors or anchoring systems provide a high-strength partition top anchor that can resist large scale lateral forces. This invention relates to an improved anchoring arrangement for use in conjunction with building construction having a wall secured at its upper limit to an overlying structure and meets the heretofore unmet need described above.

SUMMARY

In one aspect, a high-strength anchoring system for protecting the top of a partition or masonry wall from damage inflicted by lateral forces thereupon and maintaining the relationship between an overlying deck or slab and the adjoining masonry wall includes a slip tube embedded in the top of the masonry wall. The slip tube has an open end disposed at the upper most portion of the wall. An anchor is partially disposed within the slip tube. The anchor includes a rod member at one end thereof, a key member configured for disposition in the overlying deck at the other end thereof, and a transition portion between the rod member and the key member. The transition portion is configured to be at least partially disposed within the overlying deck.

In another aspect, a high-strength anchoring system for protecting the top of a partition or masonry wall from damage inflicted by lateral forces thereupon and maintaining the relationship between an overlying deck or slab and the adjoining masonry wall includes a keyway channel embedded in the overlying deck. The keyway channel has a throat opening at an exterior face of the deck. A slip tube is embedded in the masonry wall and has an open end disposed opposite the throat opening of the keyway channel. An anchor is partially disposed in the keyway channel and partially disposed in the slip tube. The anchor includes a rod member disposed in the slip tube at one end thereof, a key member disposed in the keyway channel at an opposite end thereof, and a transition portion between the rod member and the key member. The transition portion is at least partially disposed within the keyway channel.

In another aspect, an anchor for use at a junction of a masonry wall and another wall comprises one piece of material and has a longitudinal axis. The one piece of material is formed to have a rod member, a key member, and a transition portion between the rod member and the key member. At least a portion of the transition portion is aligned with the key member along the longitudinal axis.

In general terms, in one embodiment the invention is a partition top anchor and anchoring system for use in anchoring a partition or masonry wall to an overlying deck or slab. The system includes an anchor substantially disposed within a slip tube that is embedded within the uppermost portion of the wall. The anchor includes a key member that is interconnected with a keyway channel affixed to the overlying deck or slab. The anchor and slip tube are dimensioned to allow for vertical movement of the anchor during periods of high lateral forces.

In another aspect, the partition top anchor is constructed from steel or similar high-strength material. The anchor includes a rod member disposed within the slip tube and a key member interconnected within the throat of the keyway channel. The key member is integrally formed with the rod member and fully disposed within the keyway channel upon installation. The key member and the keyway channel are dovetail structures.

The slip tube houses a compressible mat set opposite the slip tube open end, which faces the throat opening in the keyway channel. Additionally, a compressible foam member is disposed between the wall and the overlying slab or deck to provide a cushion between the overlying slab and wall.

It is an object of the present invention to provide, in an anchoring system having a masonry or partition wall anchored at its highest point to an overlying structure, a high-strength partition top anchor, which includes a slip tube and channel attachment.

It is another object of the present invention to provide a specialized partition top anchor that is configured to provide a high-strength dynamic interlock between the wall and the overlying structure.

It is another object of the present invention to provide labor-saving devices to simplify installations of walls and the securement thereof to overlying structures.

It is a further object of the present invention to provide an anchoring system for a structure subjected to high lateral forces that is economical to manufacture, resulting in a relatively low unit cost.

It is a feature of the present invention that when the partition top anchor is installed within the slip tube and the channel, the partition top anchor provides vertical adjustment in response to high lateral forces.

It is a further feature of the present invention that when the partition top anchor is installed within the slip tube and the channel, the anchor resists movement along the z-axis while allowing limited movement along the x-axis.

It is another feature of the present invention that the partition top anchors are utilizable with a partition or masonry wall interconnected with a concrete or steel overlying structure.

It is yet another feature of the present invention that the partition top anchor provides a high-strength interconnection with the overlying structure.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

In the embodiment described herein, the high-strength partition top anchor and anchoring system is designed in accordance with the *Building Code Requirements for Masonry Structures, ACI* 530-05/*ASCE* 5-05/*TMS* 402-05. In order to comply with the requirements, masonry structures must be designed to resist applicable loads and provide a continuous load path(s) to properly transfer forces.

Figure 1:
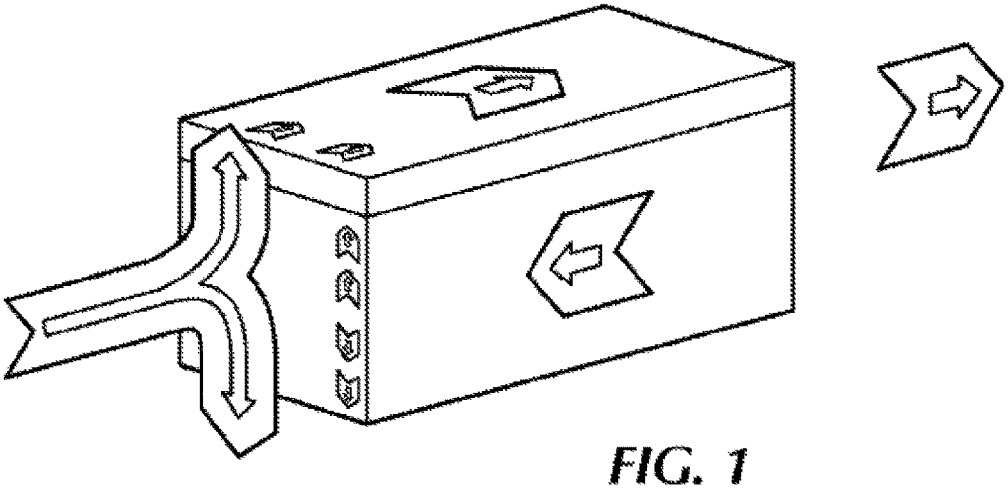
FIG. 1 is a perspective view of a building structure anchored to an overlying slab, the building structure being subjected to high wind lateral forces and showing the effects of the forces on the building structure.
Figure 2:
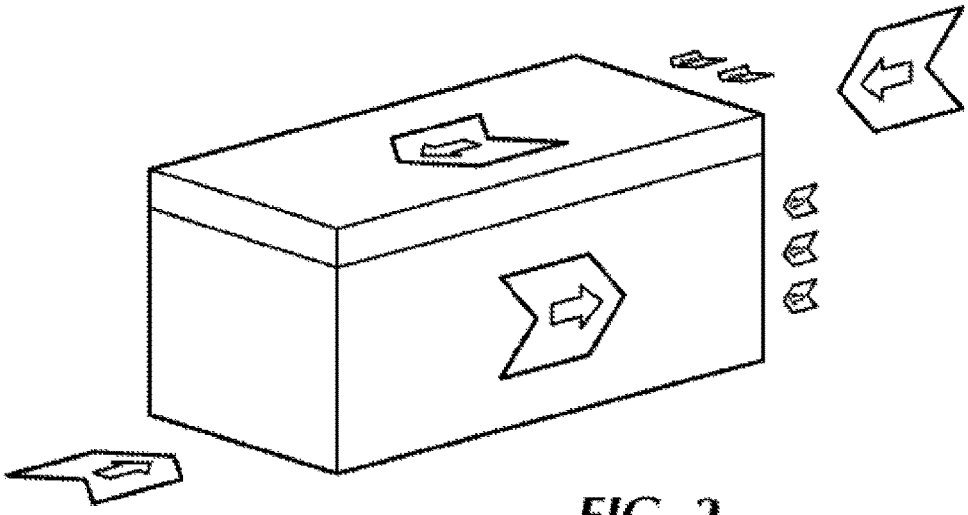
FIG. 2 is a perspective view of a building structure anchored to an overlying slab, the building structure being subjected to high seismic activity and showing the effects of the forces on the building structure.

Buildings require a structural system that is designed to resist high wind and earthquake loads. In particular application to the partition top anchors presented herein, walls must be designed to resist loads, moments and shears applied at intersections with horizontal members. The effects of lateral deflection and translation of members providing lateral support must be considered and devices used to transfer lateral support from members that intersect walls must be designed to resist the forces involved. The disclosed partition top anchors are designed to provide lateral shear resistance at the upper limit of partition or masonry walls. These anchors permit vertical deflection of the overlying slab, without transferring compressive loads to the wall below. The partition top anchors are suitable for construction having steel or concrete roofs and resist dynamic forces capable of blowing, lifting or collapsing such roof. Such forces and their effect on building structures are shown in FIG. 1 (high-winds) and FIG. 2 (seismic).

Figure 3:
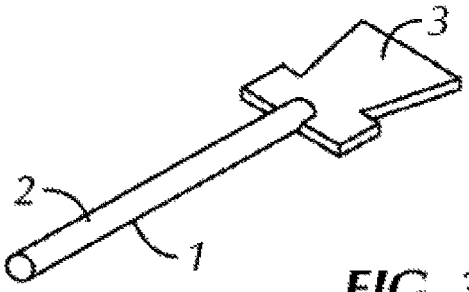
FIG. 3 Prior Art
FIG. 3 is a perspective view of the prior art partition top anchor having the rod and dovetail head welded together.
Figure 3A:
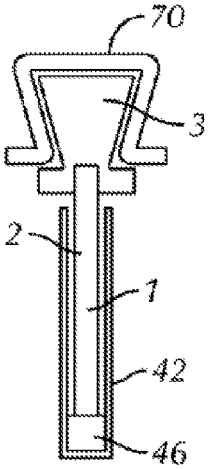
FIG. 3A Prior Art
FIG. 3*a* is a side view of the prior art partition top anchor set within the channel, the welded interconnection between the rod and the dovetail head lie outside the channel, the anchor is set within a slip tube with a foam stopper set therein.
Figure 4:
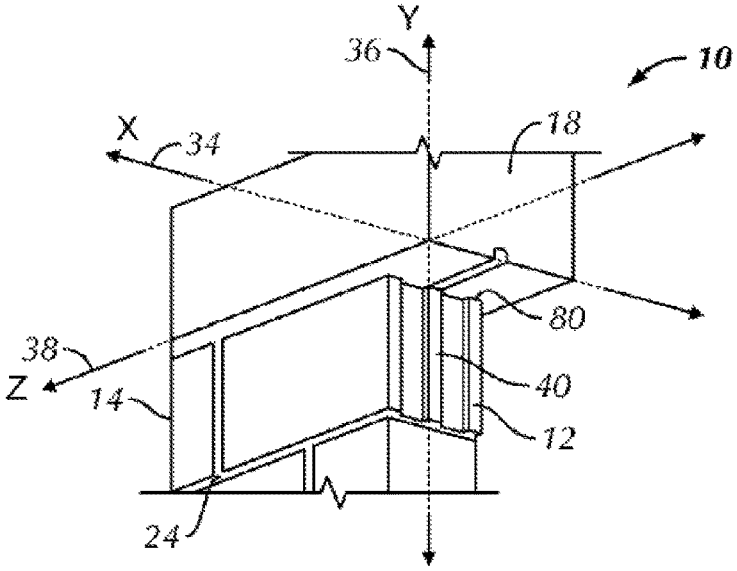
FIG. 4 is a perspective view of the disclosed partition top anchor and anchoring system having a partition top anchor inserted within a slip tube set within a masonry wall and secured within a channel secured to an overlying concrete slab.
Figure 5:
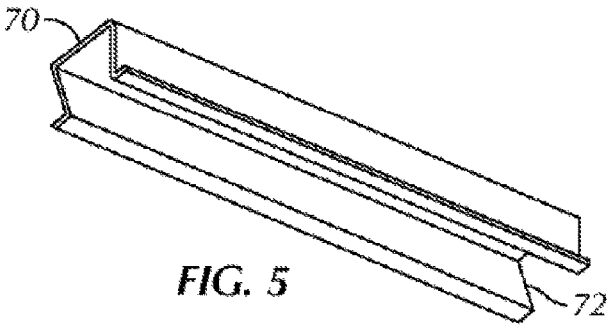
FIG. 5 is a perspective view of the channel of FIG. 4.
Figure 6:
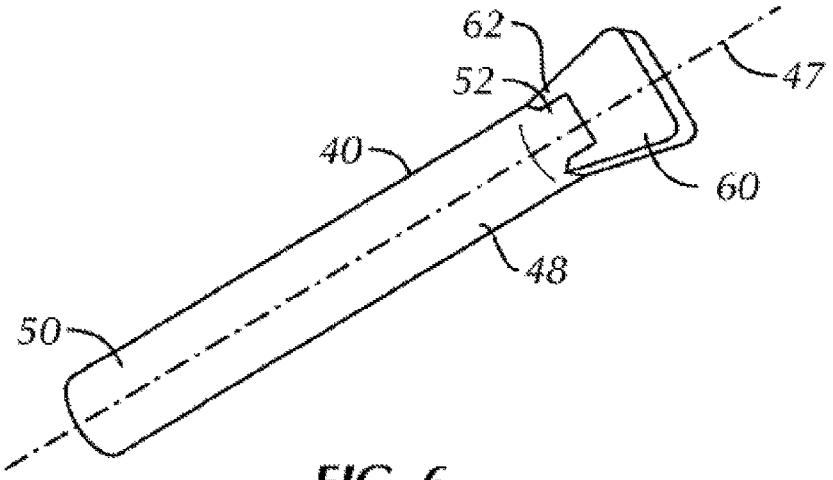
FIG. 6 is a perspective view of the partition top anchor of FIG. 4.
Figure 7:
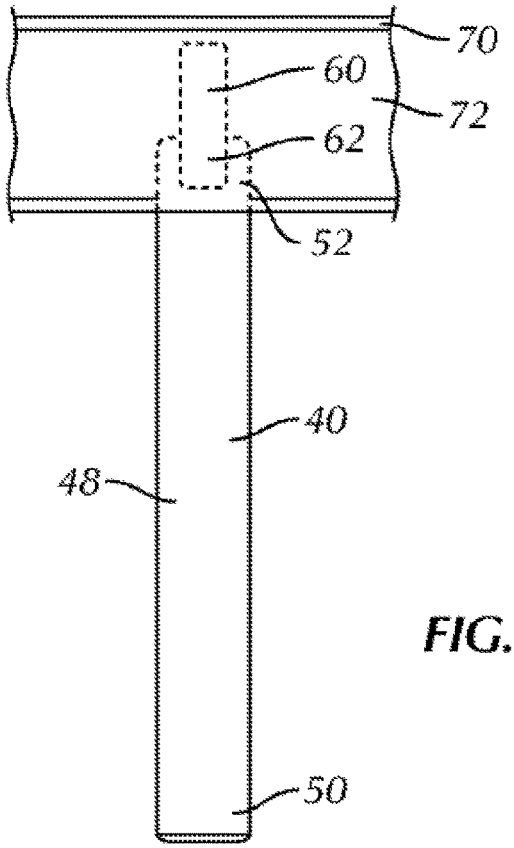
FIG. 7 is a side view of the partition top anchor and anchoring system of FIG. 4 with the anchor set within the channel.
Figure 8:
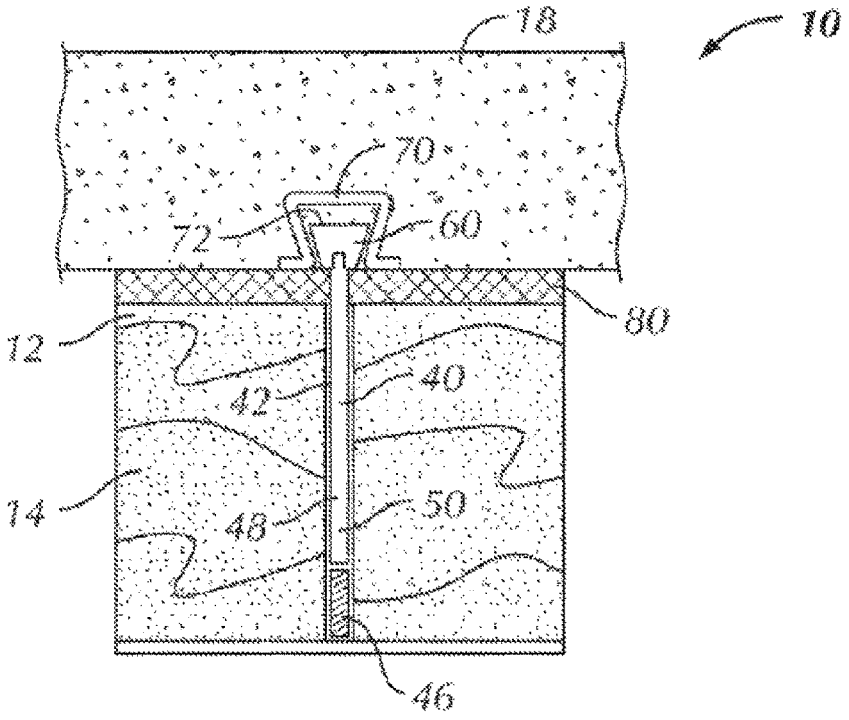
FIG. 8 is a cross-sectional view of the partition top anchor and anchoring system of FIG. 4 having a partition top anchor set within a slip tube and the channel, the slip tube having a foam stopper and the channel embedded within the overlying concrete slab, a foam structure is emplaced between the wall and the overlying slab.
Figure 9:
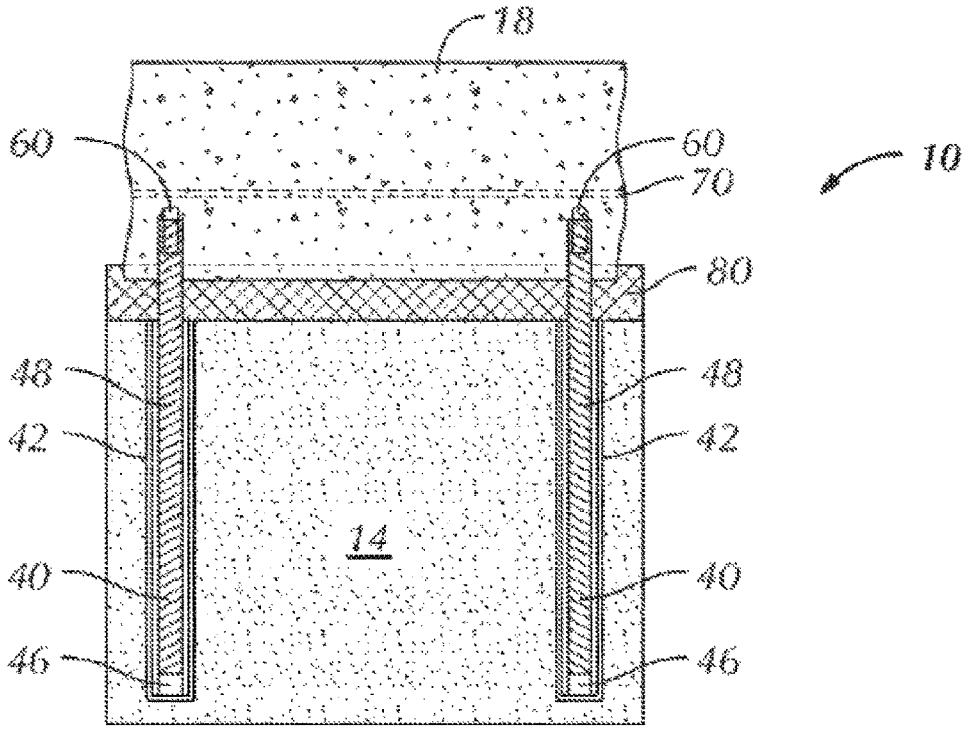
FIG. 9 is a cross-sectional view of the partition top anchor and anchoring system of FIG. 4 having two partition top anchors set within slip tubes and the channel, each slip tube having a foam stopper placed therein and the channel affixed to a overlying steel structure, a foam structure is emplaced between the wall and the overlying slab.
Figure 10:
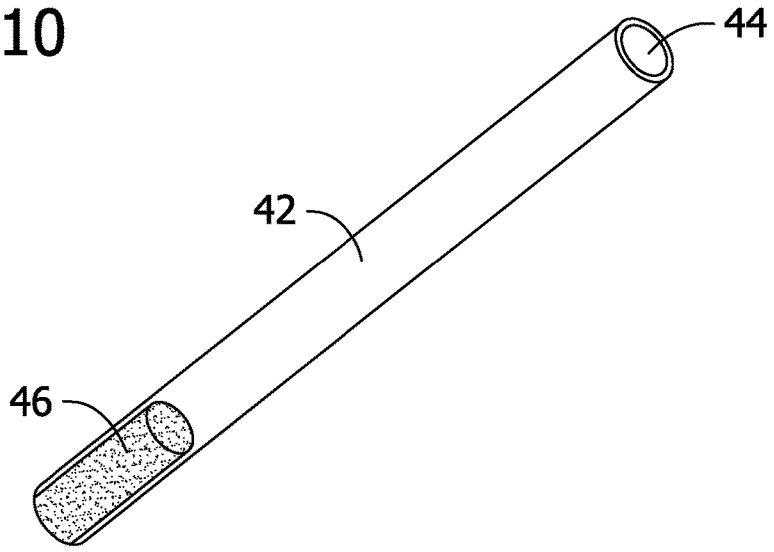
FIG. 10 is a perspective view of the slip tube of FIG. 4 with the foam stopper placed therein.
Figure 11:
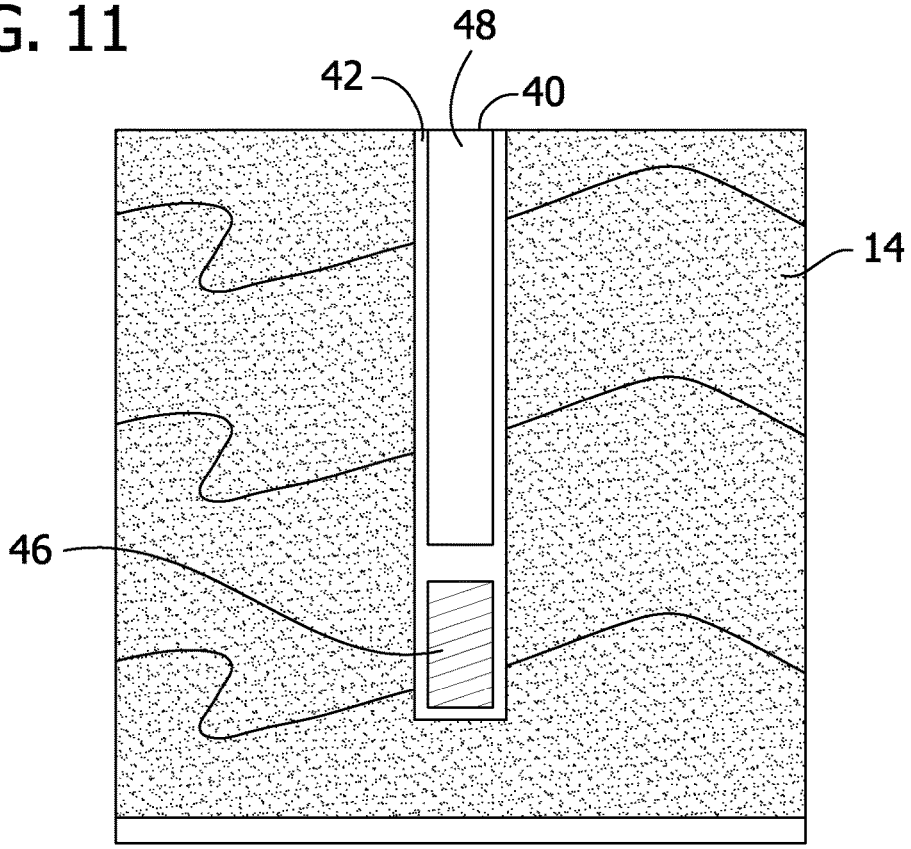
FIG. 11 is a cross-sectional view of the slip tube and foam stopper with the partition top anchor set therein.

The prior art anchors and anchoring systems are shown in FIGS. 3 and 3*a*. The anchor 1 is comprised of two components, a metal rod 2 and a metal dovetail head 3. The dovetail head 3 is welded to the metal rod 2. When installed, the anchor 1 is set within a slip tube 42, having a foam stopper or filler 46 set therein. The slip tube 42 is embedded in a vertical wall structure (not shown) and interconnected with a metal keyway channel 70. The channel 70 is embedded or affixed to an overlying slab or structure (not shown). When set within the slip tube 42 and connected to the channel 70, the anchor rod 2 and portion of the dovetail head 3 welded to the rod 2 sit outside the channel 70. When emplaced within the structure and subjected to high-strength lateral forces, the lateral forces set on the weak interconnection point between the dovetail head 3 and the rod 2, resulting in the failure and separation of the dovetail head 3 and the rod 2. Such separation causes the overlying slab to dislodge from the wall, causing structural damage and resulting safety concerns. The present invention improves on the prior art anchor by modifying the anchor design and refocusing the forces on the high-strength rod and away from the interconnection point.

Referring now to FIGS. 4 through 11, the partition top anchor and anchoring system of this invention is shown and is referred to generally by the number 10. A wall structure 12 is shown having a partition or masonry wall 14 and an overlying deck or slab 18 of concrete or steel components.

For purposes of discussion, the exterior surface 24 of the wall structure 12 contains a horizontal line or x-axis 34 and an intersecting vertical line or y-axis 36. A horizontal line or z-axis 38, normal to the xy-plane, also passes through the coordinate origin formed by the intersecting x- 34 and y-axes 36. In the discussion which follows, it will be seen that the partition top anchors 40 are constructed to restrict movement interfacially along the z-axis 38 and allow for limited movement along the x-axis 34 and the y-axis 36. The device 10 includes a partition top anchor 40 constructed for insertion within a slip tube 42 embedded in the wall 14 and interconnection with a keyway channel 70 affixed to the deck 18.

The slip tube 42 is embedded in the top of the wall 14 and the vertical joint is then filled with mortar, fully surrounding the exterior of the slip tube 42. The slip tube 42 is a polymeric or other structure capable of maintaining its structure when embedded within the wall 14 and has an open end 44 disposed at the upper most portion of the wall 14. The slip tube has a predetermined diameter. A compressible mat or expansion filler 46 is set within the slip tube 42 at the bottom of the slip tube 42 away from the open end 44. The filler 46 restricts mortar entry into the slip tube 42 and allows for anchor 40 deflection. The anchor 40 is partially disposed within the slip tube 42.

The anchor 40 is constructed from a high-strength material such as galvanized steel, hot dip galvanized steel, stainless steel, or bright basic steel. The anchor 40 includes a rod member 48 that is substantially disposed within the slip tube 42. The rod member 48 has a predetermined diameter. The rod member diameter is in a close fitting functional relationship with the slip tube 42 diameter, allowing the rod member 48 to be vertically adjusted within the slip tube 42 when subjected to lateral forces. The close fitting relationship between the diameter of the rod member 48 and the slip tube 42 diameter restricts anchor 40 movement within the slip tube 42 along the x- 34 and z-axes 38.

The rod member 48 includes an insertion portion 50, set within the slip tube 42 adjacent to the filler 46, and an interconnecting portion 52. A key member 60, having a substantially dovetail shape, is integrally formed with the rod member 48 and has a common longitudinal axis 47 therewith. The key member 60 is partially formed from the rod interconnecting portion 52. The key member 60 insertion member 62 is welded within the interconnecting portion 52, forming a high-strength bond between the rod member 48 and the key member 60.

The key member 60 is configured to be disposed entirely within the keyway channel 70 which is embedded within the overlying deck 18. The keyway channel 70 has a throat opening 72 at the deck 18 exterior face plane. The open end 44 of the slip tube 42 is disposed opposite the throat opening 72. The key member 60 interlocks with the keyway channel 70 and the key member 60 is disposed within the throat opening 72 of the keyway channel 70. The key member 60 is a dovetail fitting having a substantially similar dimension to the keyway channel 70. When the key member 60 is inserted within the keyway channel 70, key member 60 movement is restricted along the y- 36 and z-axis 38 and limited along the x-axis 34.

The anchoring system further includes a compressible foam member 80 set between the deck 18 and the wall 14. The foam member 80 serves to separate the deck 18 and the wall 14 and temper the compressive forces acting on the structure 12.

The presently presented partition top anchor 40 serves to dynamically interconnect the wall 14 and the deck 18. The dynamic nature of the anchor 40 and its ability to vertically adjust during occurrences of high-lateral forces serves to contain the forces and provide a proper load path to restrict structural damage. The use of the dynamic partition top anchor 40 resists tensile forces tending to lift or separate walls and overlying structures, while protecting the top of a partition or masonry wall 14 from damage inflicted by lateral forces thereupon and maintaining the relationship between an overlying deck or slab 18 and the adjoining wall 14.

The present invention improves on the prior art partition top anchors 1 through its novel design that ensures that the key member 60 is completely located within the keyway channel 70. This design ensures that the high lateral forces are focused on the high-strength steel rod member 48 and not the prior art weld point between the rod 2 and the dovetail member 3. The present invention improves the prior art design by reengineering the key member 60 as an integral component of the rod member 48—bonding the key member 60 within the rod member 48—thereby providing a high-strength welded connection. The present invention provides greater protection against anchor separation during periods of high lateral loads and greater structural strength than the prior art designs.

Referring now to FIGS. 12-15, in another embodiment a partition top anchor 140 is formed as one piece of material. The partition top anchor 140 includes a rod member 148 and a key member 160. The rod member 148 is substantially similar to the rod member 48 as described above. The rod member 148 is configured to be disposed in the slip tube 42 embedded in the partition or masonry wall 14, as described above with reference to rod member 48. The key member 160 is similar to the key member 60 as described above, with the exception that it is formed as one piece of material with the rod member 148. The key member 160 is configured to be disposed in the keyway channel 70 embedded in the overlying deck or slab 18, as described above with reference to key member 60.

Figure 12:
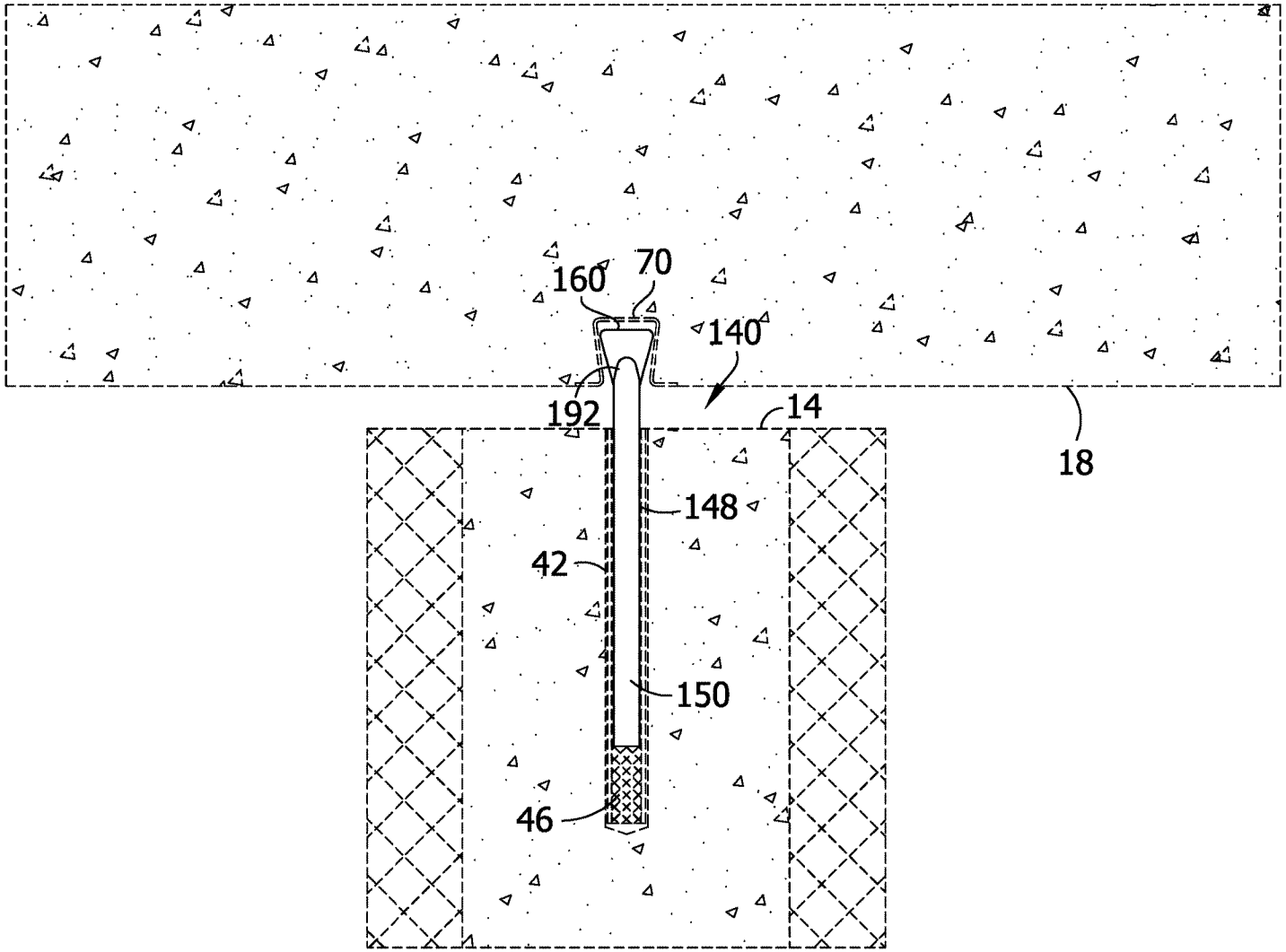
FIG. 12 is a partial cross section of a building structure anchored to an overlying slab by a one-piece partition top anchor having a transition portion.
Figure 13:
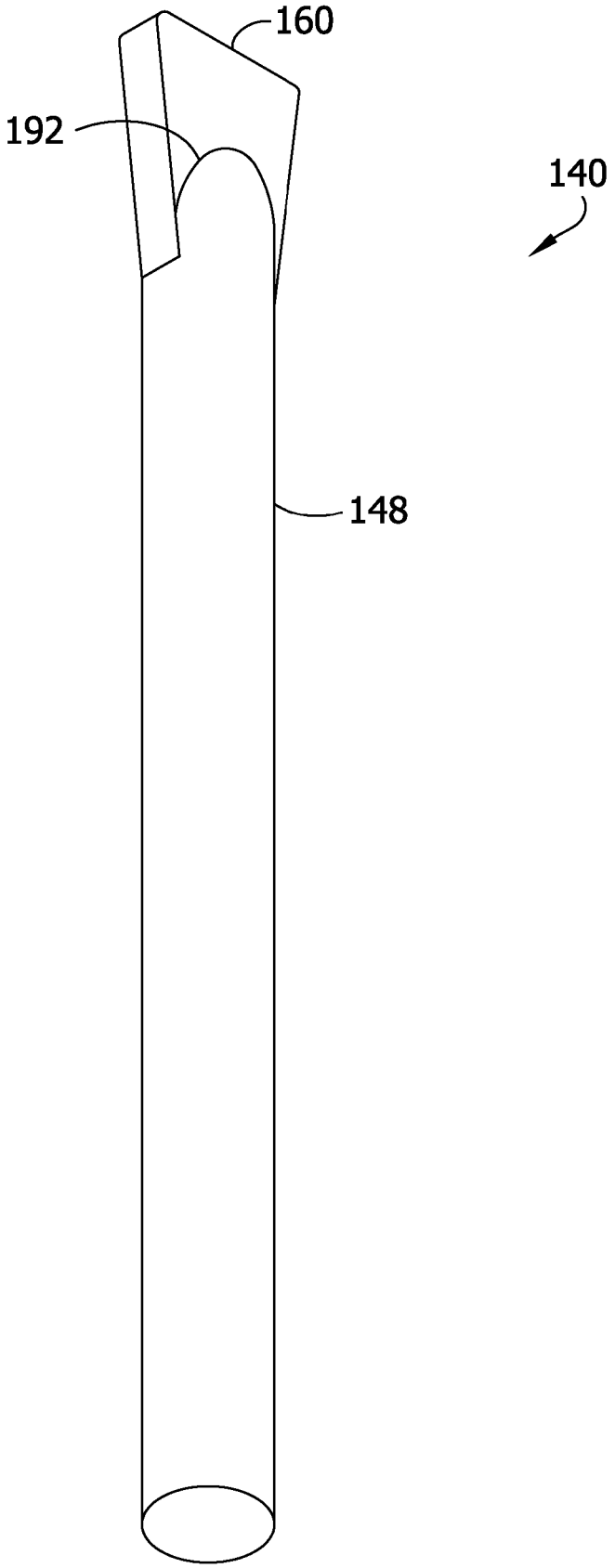
FIG. 13 is a perspective of the partition top anchor of FIG. 12.
Figure 14:
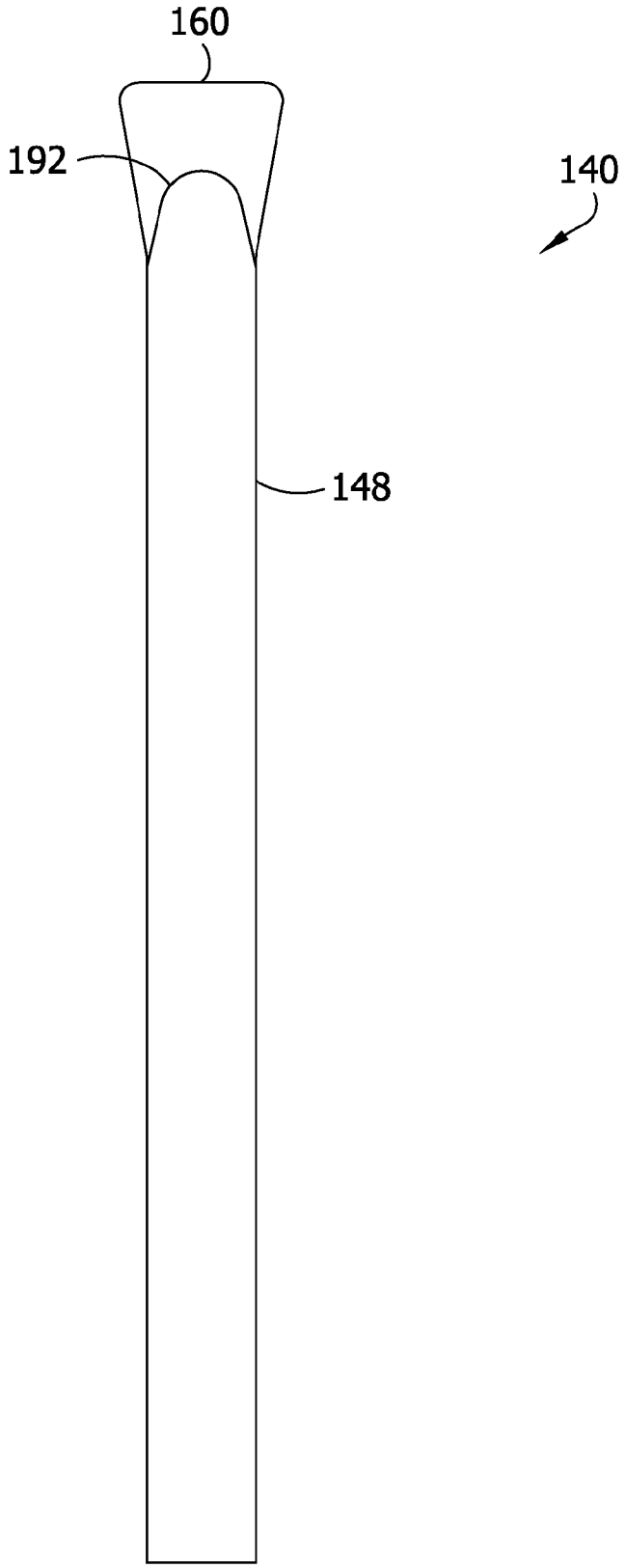
FIG. 14 is a front elevation thereof.
Figure 15:
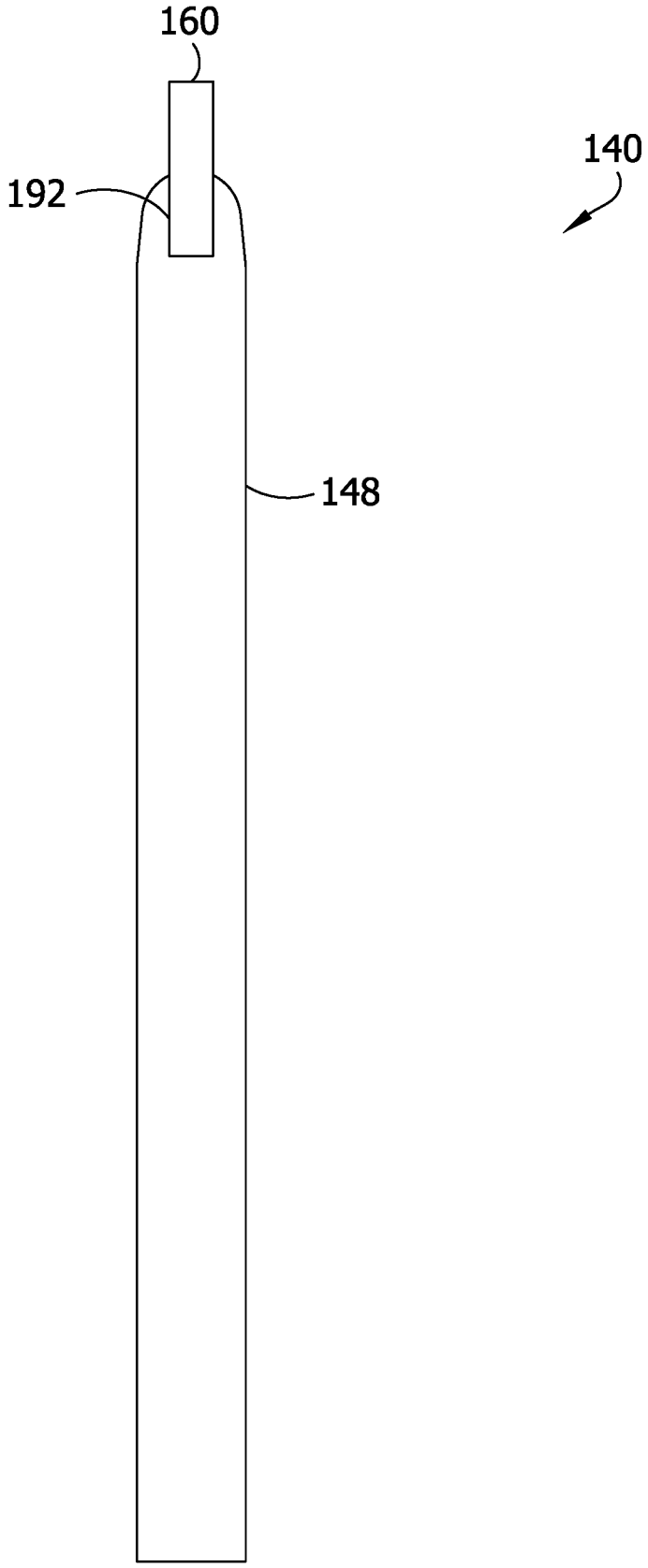
FIG. 15 is a side elevation thereof.
Figure 16:
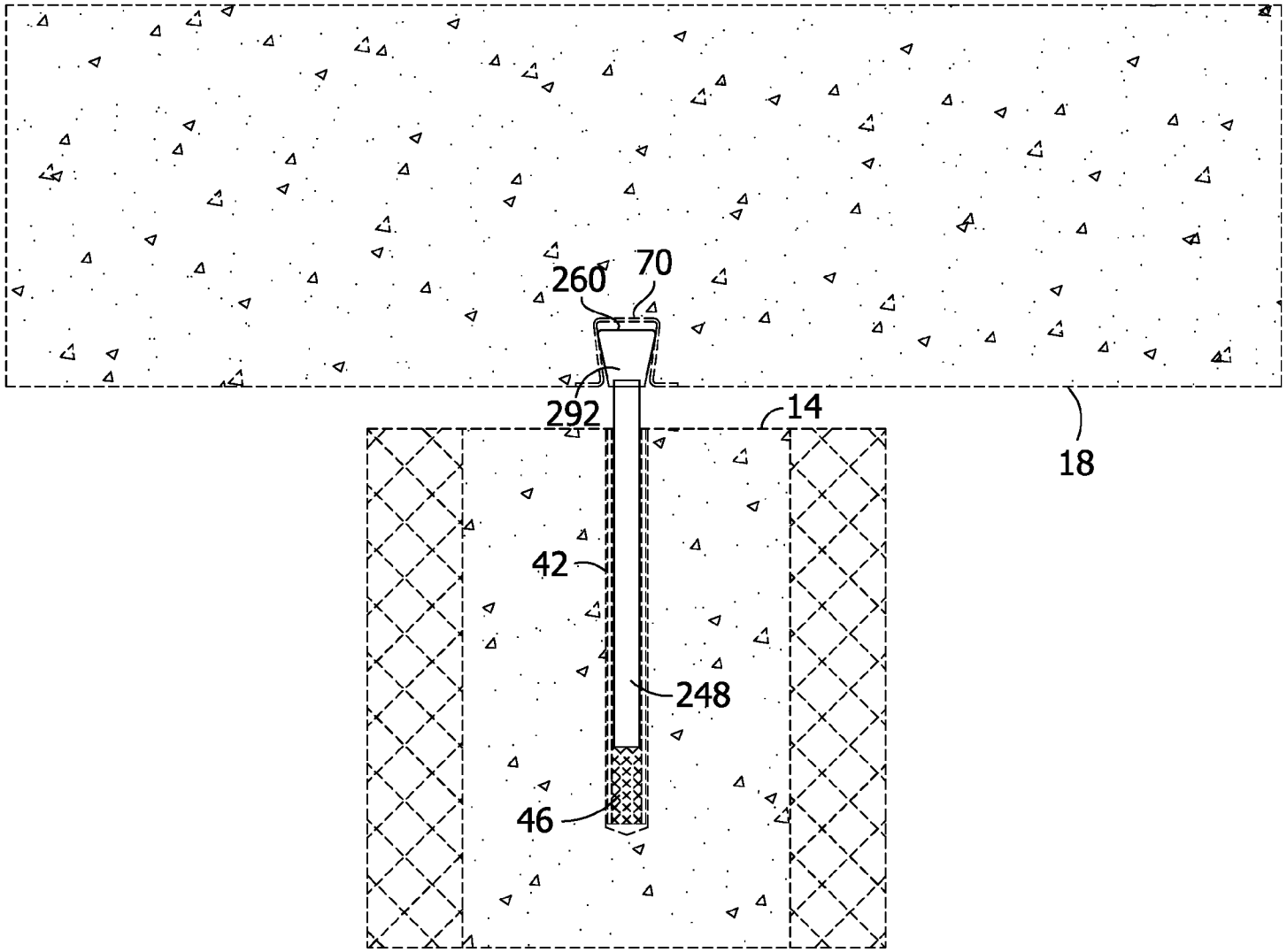
FIG. 16 is a partial cross section of a building structure anchored to an overlying slab by a partition top anchor having a round rod member and a transition portion.
Figure 17:
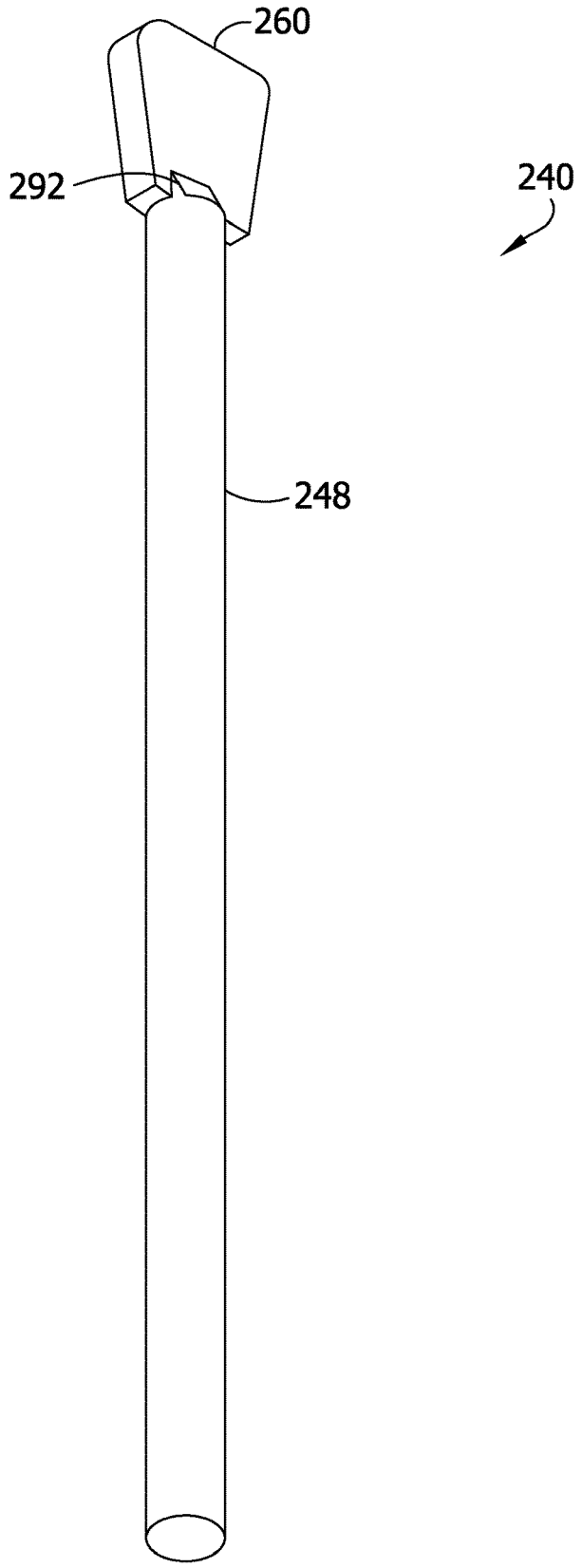
FIG. 17 is a perspective of the partition top anchor of FIG. 16.
Figure 18:
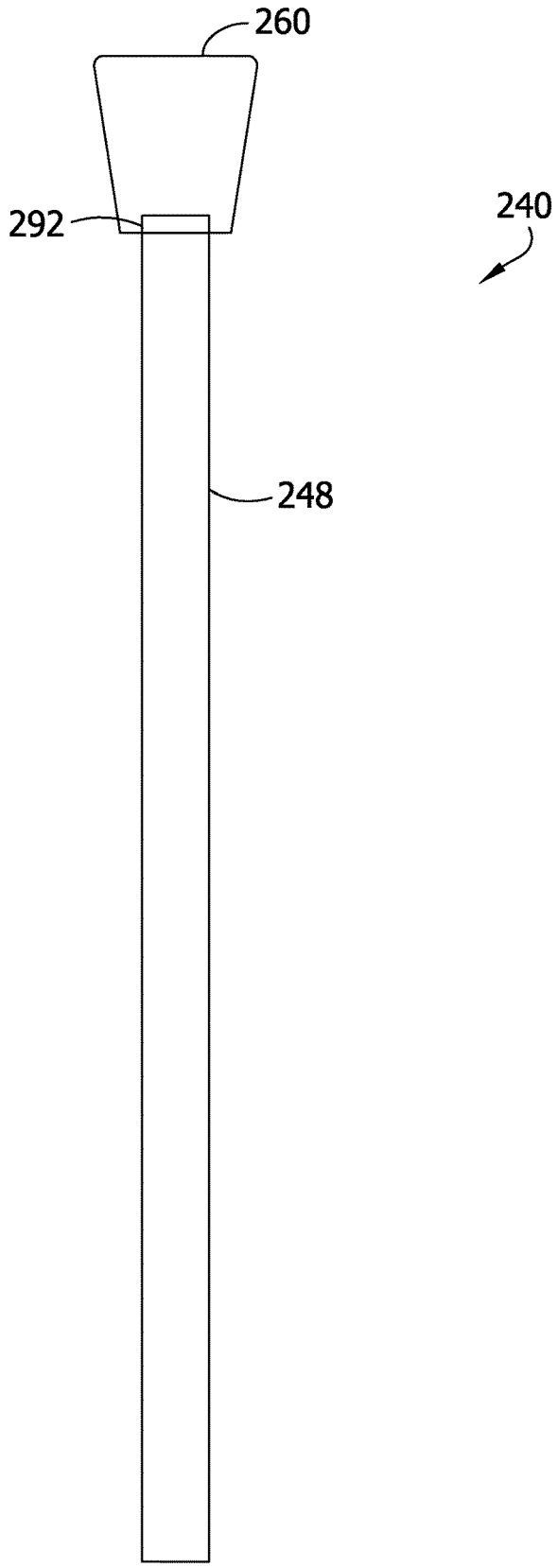
FIG. 18 is a front elevation thereof.
Figure 19:
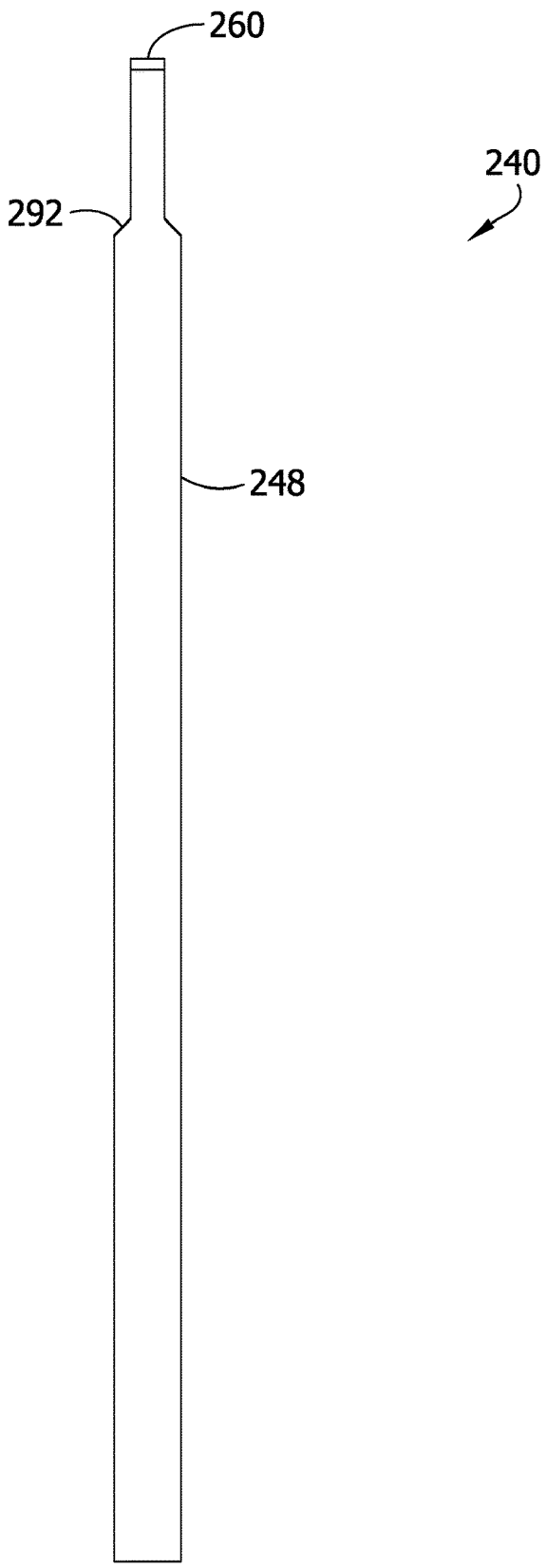
FIG. 19 is a side elevation thereof.

The rod member 148 includes an insertion portion 150 configured to be disposed in the slip tube 42 adjacent the filler 46. The key member 160 is opposite the insertion portion 150 of the rod member 148. The one-piece partition top anchor 140 includes a transition portion 192 between the key member 160 and the rod member 148 where the key member and the rod member overlap. The transition portion 192 transitions from the generally constant diameter rod member 148 to the key member 160. Generally, the transition portion 192 tapers to the key member 160. The key member 160 tapers toward the rod member 148 and the transition portion 192. The key member 160 has a generally dovetail shape, as described above with reference to key member 60. As seen in FIG. 12, at least part of the transition portion 192 is disposed within the keyway channel 70 when the anchor 140 is in use. Preferably, the entire transition portion 192 is disposed within the keyway channel 70 when the anchor 140 is in use. Preferably, the entirety of the key member 160 is positioned in the keyway channel 70 when the anchor is in use. However, it is to be understood that a portion of either the transition portion 192 or the key member 160 may be disposed outside of the keyway channel 70 within the scope of the present invention.

The one-piece partition top anchor 140 is formed as one piece of material. The anchor 140 is constructed from a high-strength material, such as galvanized steel, hot dip galvanized steel, stainless steel, bright basic steel, or other suitable material. The anchor 140 can be forged (e.g., hot forged, die forged, cold forged, press forged, etc.). In one embodiment, a length of bar stock is forged to form the key member 160 and transition portion 192 at one end thereof, the remainder of the length of bar stock forming the rod member 148. Alternatively, the one-piece partition top anchor 140 can be cast as one piece of material. It is understood that other configurations and methods of forming the anchor 140 as one piece of material are within the scope of the present invention.

Figure 20:
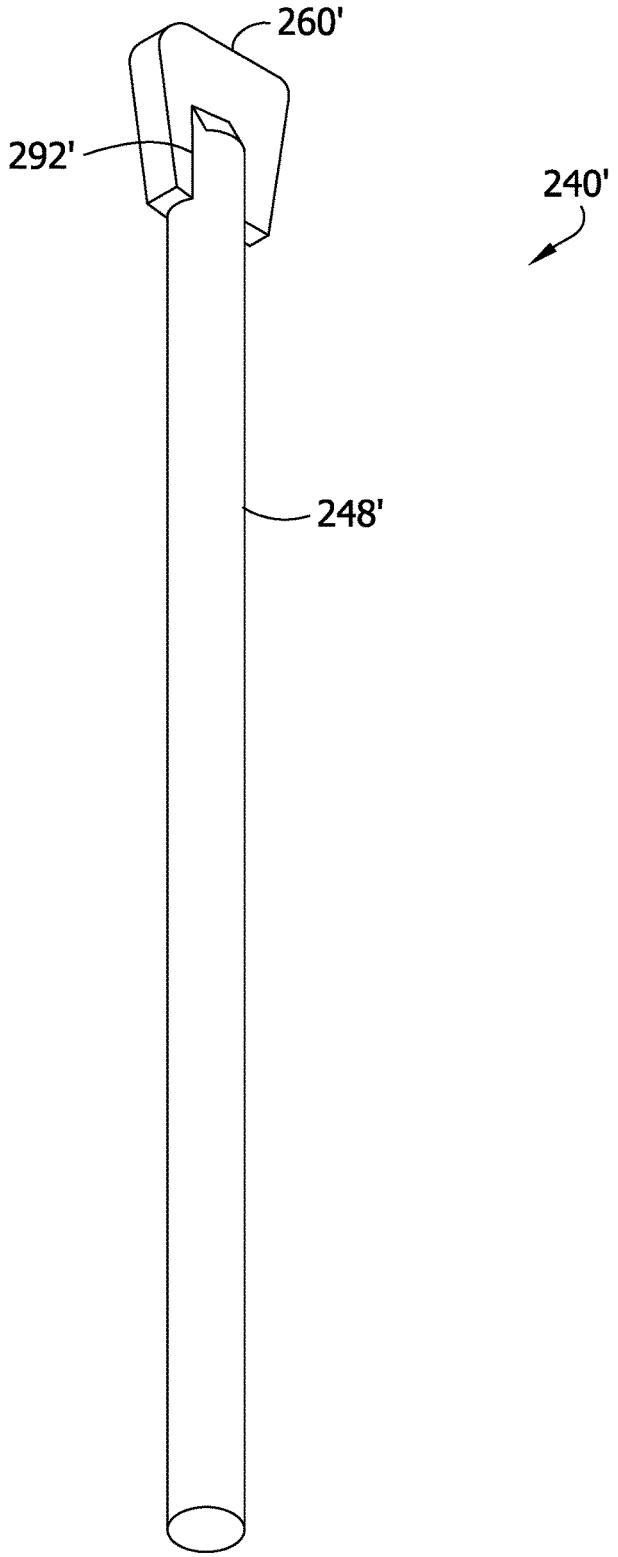
FIG. 20 is a perspective of a partition top anchor with a round rod member and an extended transition portion.
Figure 21:
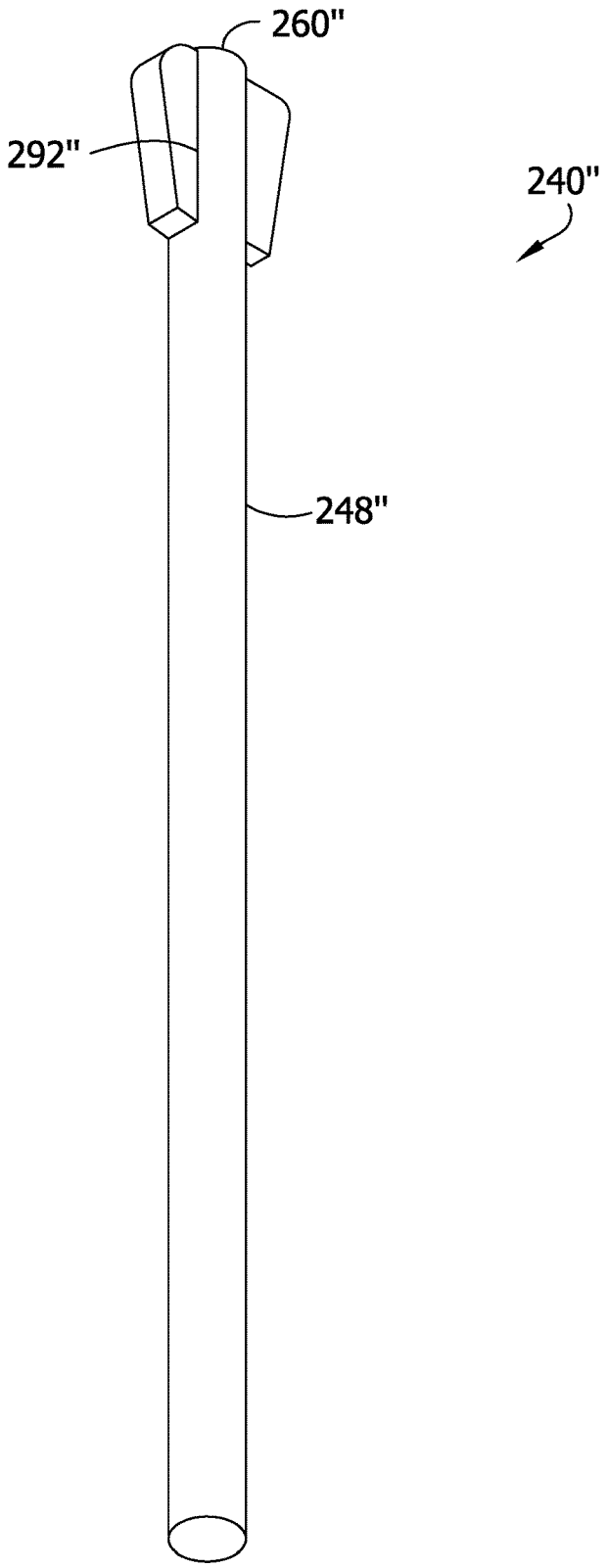
FIG. 21 is a perspective of a partition top anchor with a round rod member and extended transition portion.

FIGS. 16-30 illustrate additional embodiments of the one-piece partition top anchor. It is understood that any of the embodiments of FIGS. 16-30 can be formed as one piece of material, such as by forging, casting, or other suitable method. In FIGS. 16-19, a one-piece partition top anchor 240 including a rod member 248, a key member 260, and a transition portion 292 is forged as one piece of material from round bar stock. FIG. 20 illustrates an anchor 240' including an extended transition portion 292'. The transition portion 292' extends about halfway up the length of the key member 260'. In FIG. 21, a transition portion 292" of an anchor 240" extends approximately the full length of the key member 260".

Figure 22:
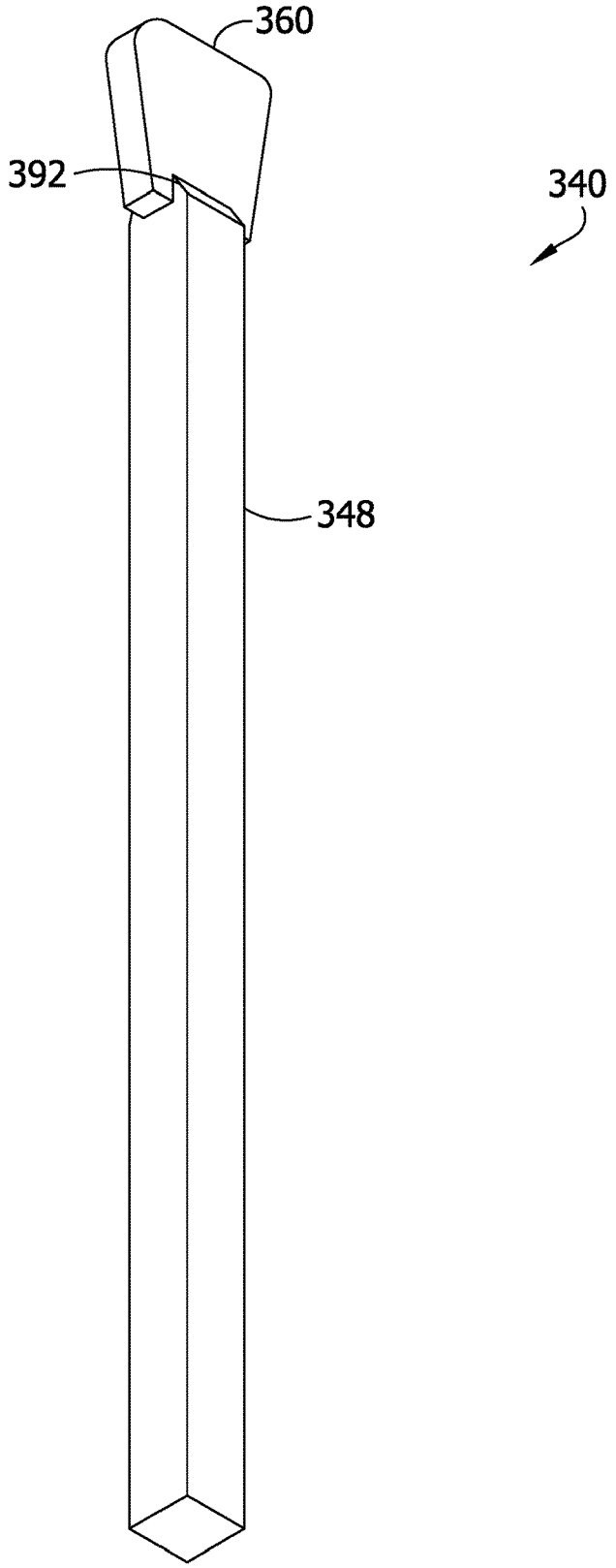
FIG. 22 is a perspective of a partition top anchor, including a square rod member.
Figure 23:
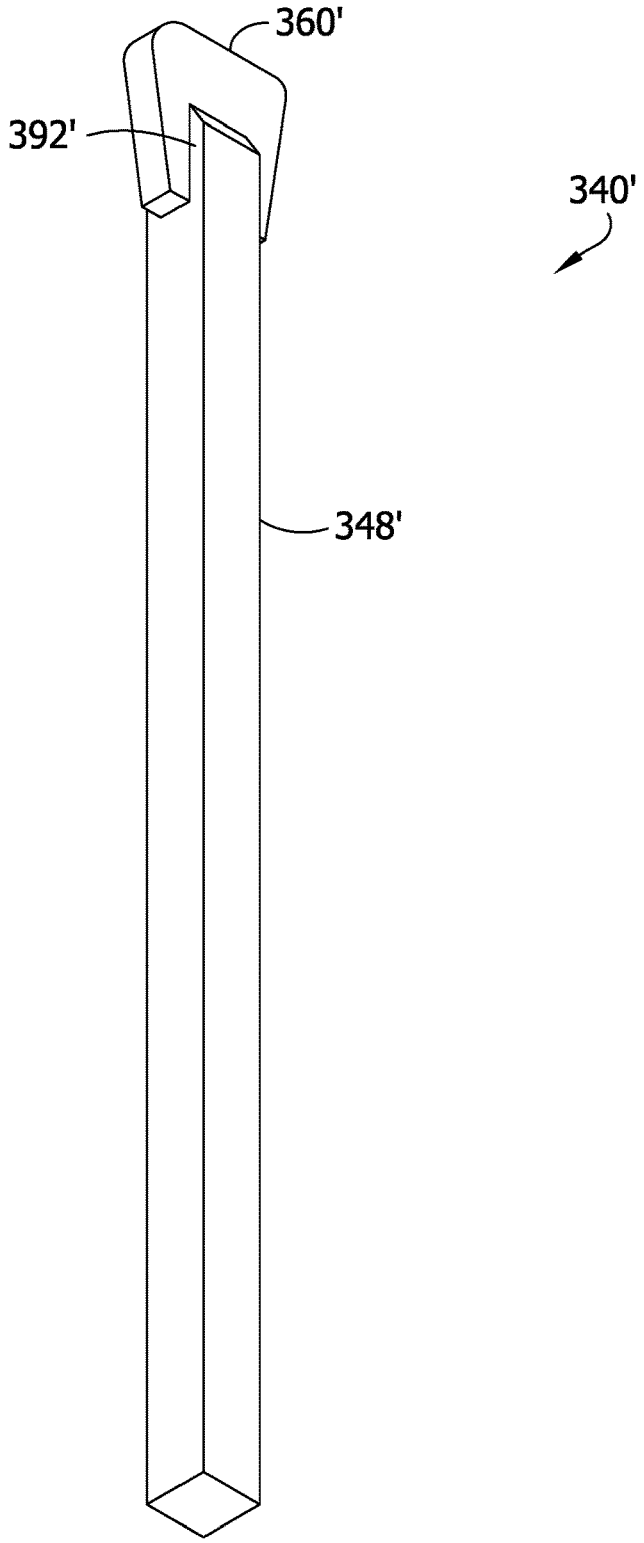
FIG. 23 is a perspective of a partition top anchor, including a square rod member and an extended transition portion.
Figure 24:
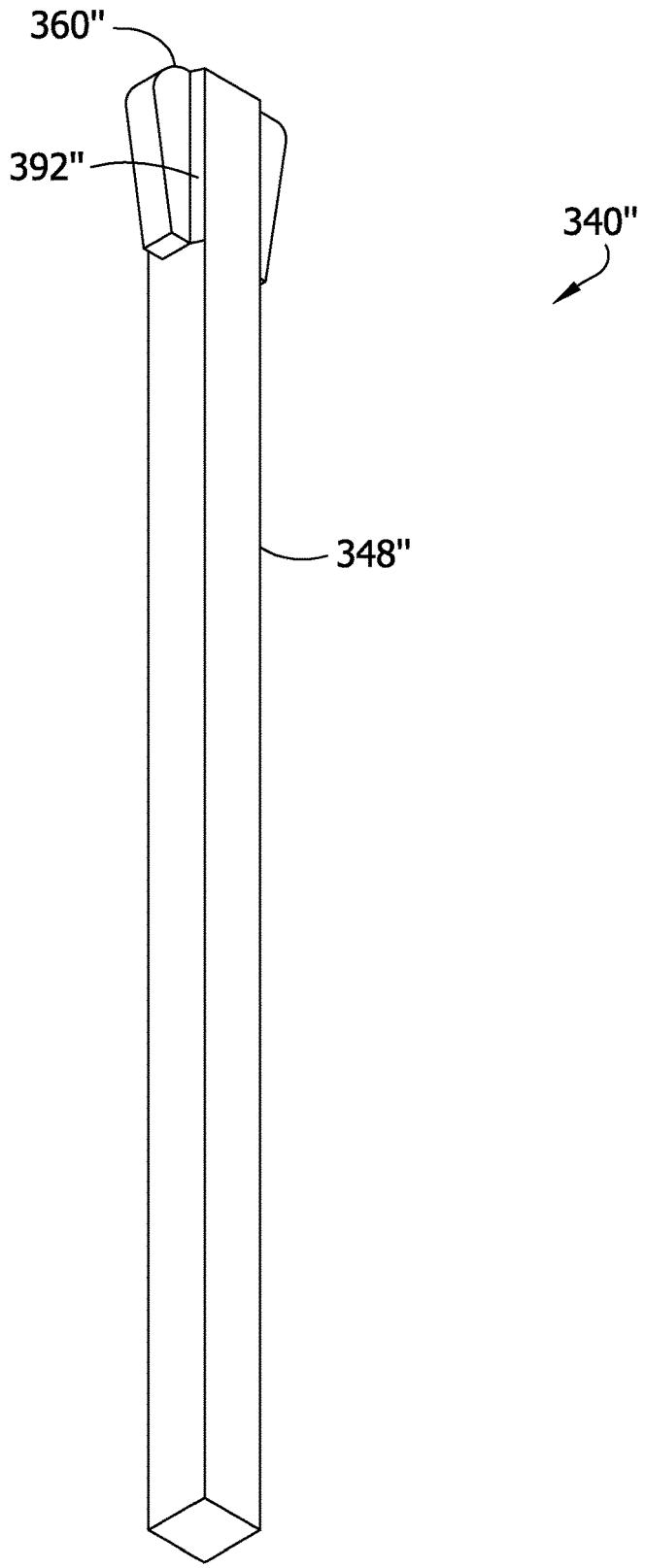
FIG. 24 is a perspective of another embodiment of a partition top anchor, including a square rod member and an extended transition portion.

In FIG. 22, a one-piece partition top anchor 340 including a rod member 348, a key member 360, and a transition portion 392 is forged as one piece of material from square bar stock. FIG. 23 illustrates an anchor 340' including an extended transition portion 392'. The transition portion 392' extends about halfway up the length of the key member 360'. In FIG. 24, a transition portion 392" of an anchor 340" extends approximately the full length of the key member 360". The transition portion 392" does not taper into the key member 360".

Figure 25:
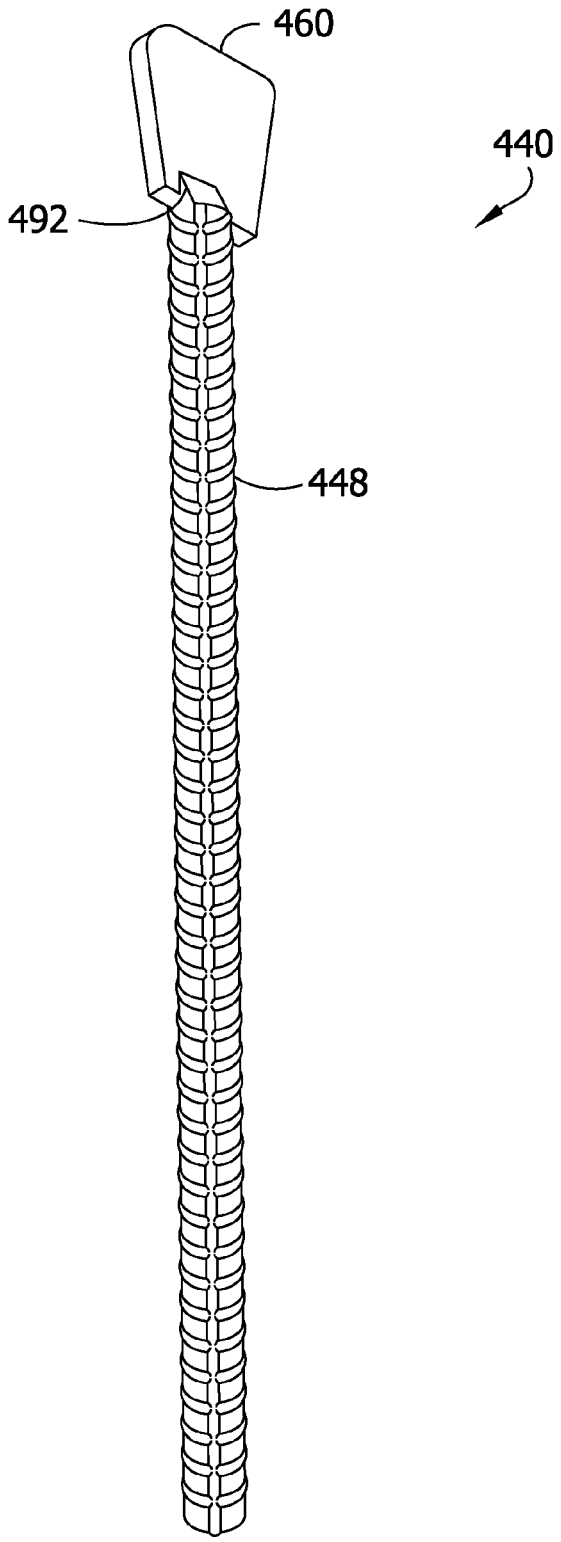
FIG. 25 is a perspective of another embodiment of a partition top anchor, including a rebar rod member.
Figure 26:
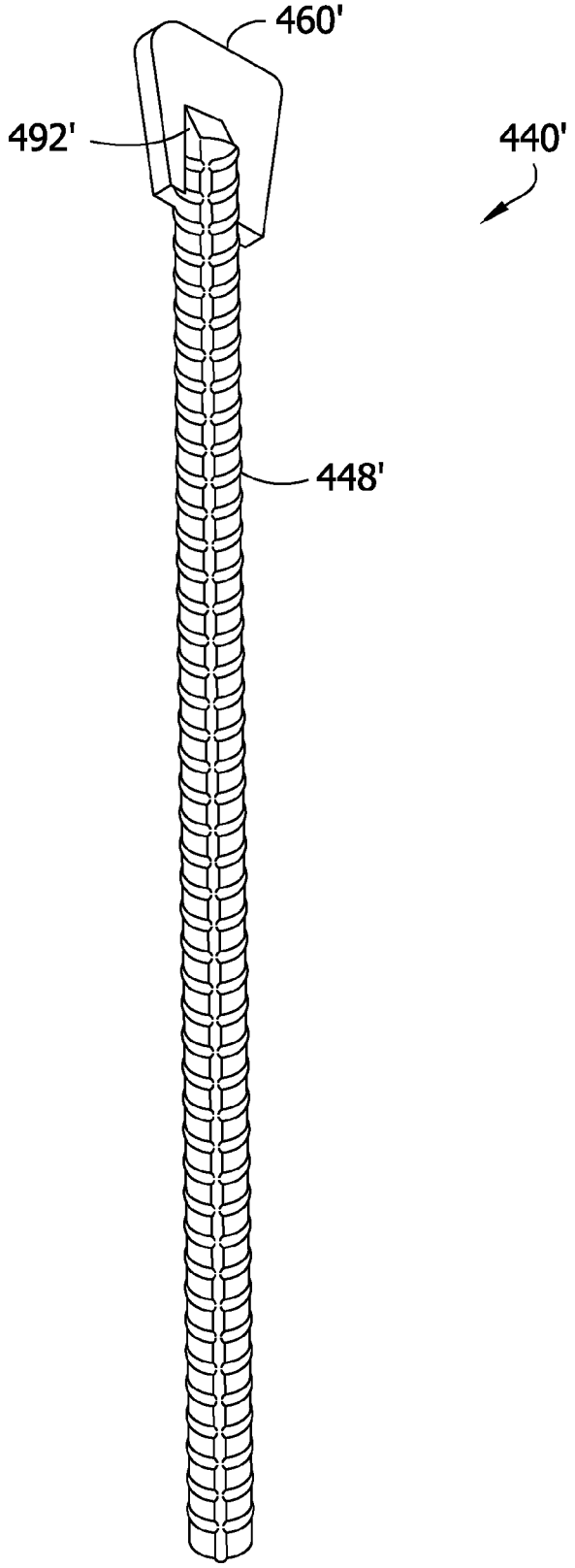
FIG. 26 is a perspective of another embodiment of a partition top anchor, including a rebar rod member and an extended transition portion.
Figure 27:
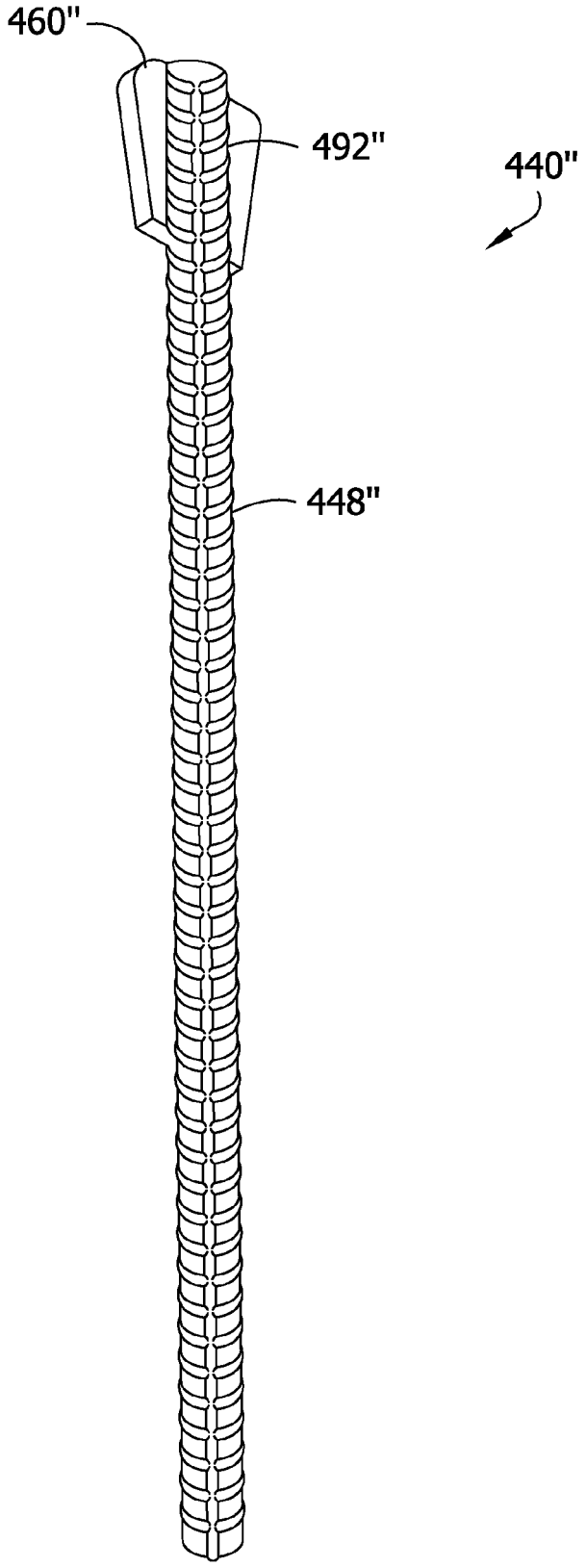
FIG. 27 is a perspective of a partition top anchor including a rebar rod member and an extended transition portion.

As shown in FIG. 25, a one-piece partition top anchor 440 including a key member 460 and a transition portion 492 has a rebar rod member 448. FIG. 26 illustrates an anchor 440' including an extended transition portion 492'. The transition portion 492' extends about halfway up the length of the key member 460'. In FIG. 27, a transition portion 492" of an anchor 440" extends approximately the full length of the key member 460".

Figure 28:
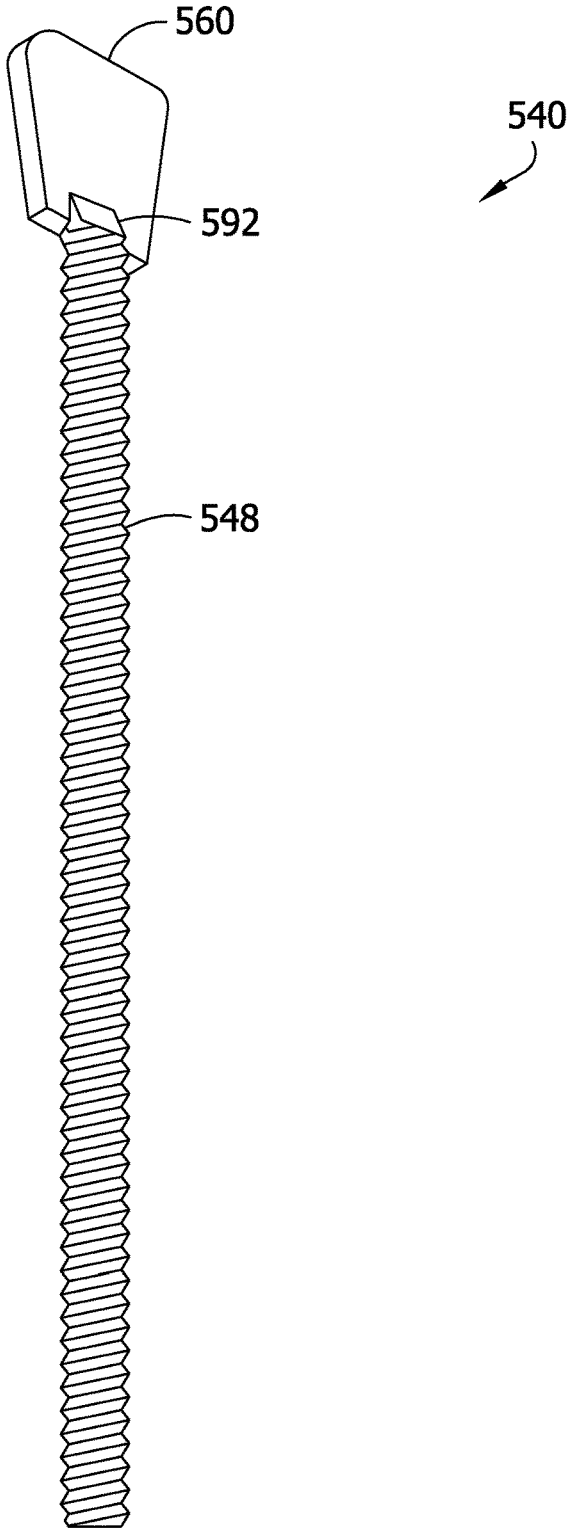
FIG. 28 is a perspective of a partition top anchor including a threaded rod member.
Figure 29:
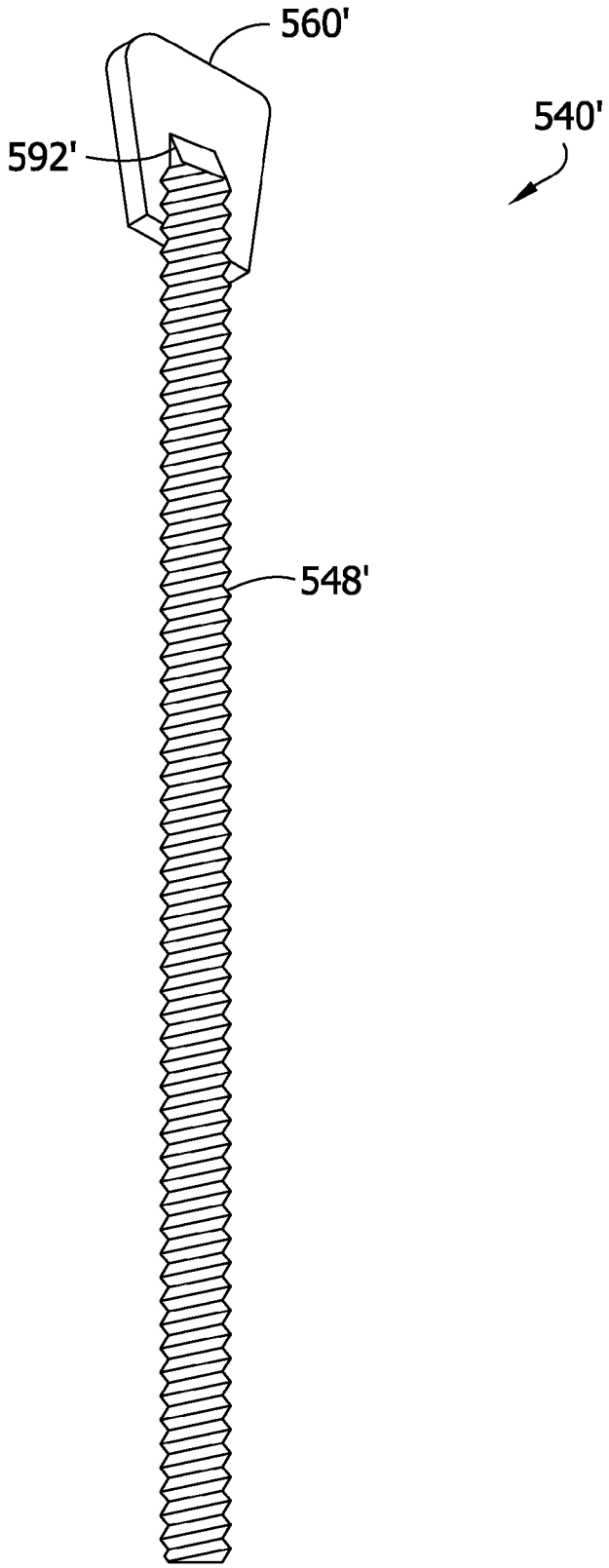
FIG. 29 is a perspective of a partition top anchor including a threaded rod member and an extended transition portion.
Figure 30:
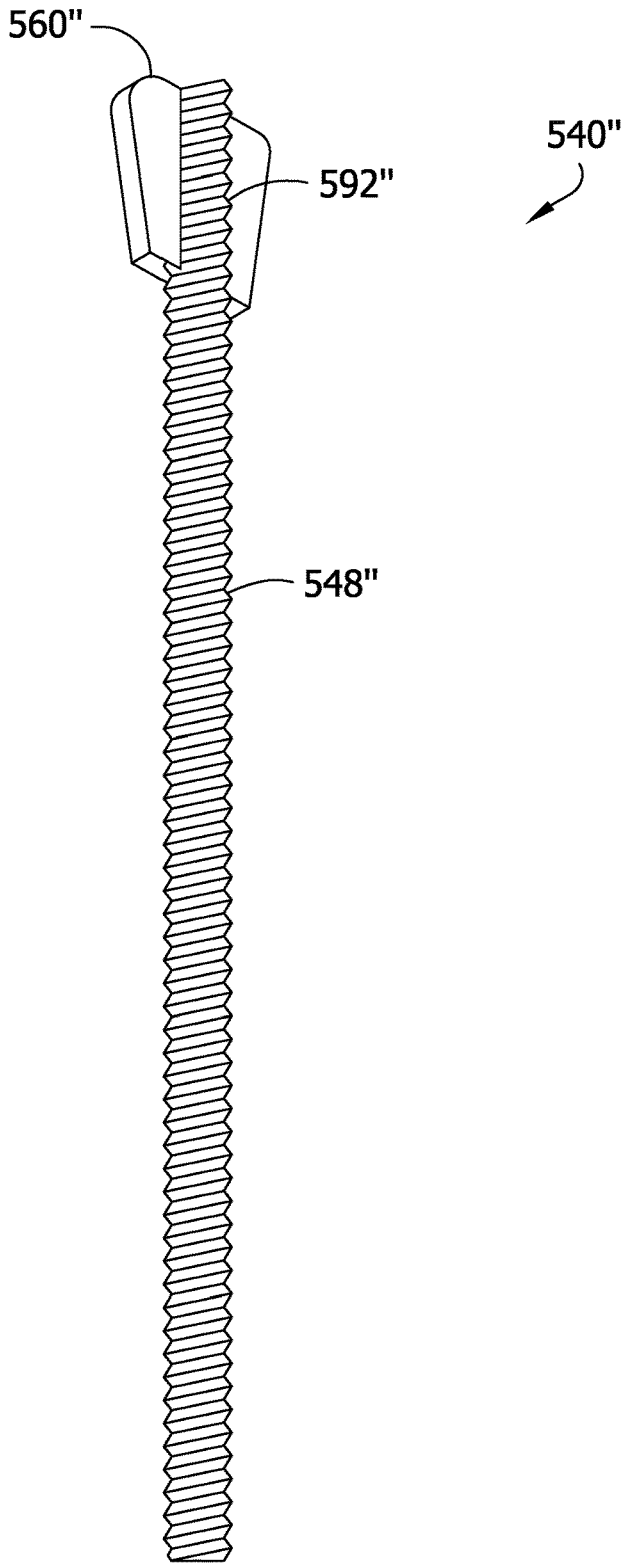
FIG. 30 is a perspective of a partition top anchor including a threaded rod member and an extended transition portion.

In FIG. 28, the rod member 548 of anchor 540 is threaded. FIG. 29 illustrates an anchor 540' including an extended transition portion 592'. The transition portion 592' extends about halfway up the length of the key member 560'. In FIG. 30, a transition portion 592" of an anchor 540" extends approximately the full length of the key member 560".

In each of the embodiments illustrated in FIGS. 12-30, the transition portion of the anchor is at least partially received in the keyway channel 70 when the anchor is in use, and preferably is entirely disposed in the keyway channel during use. As the transition portion begins at a bottom-most location of the key member, preferably the entirety of the key member is positioned in the keyway channel during use of the anchor. However, it is to be understood that a portion of either the transition portion or the key member may be disposed outside of the keyway channel 70 within the scope of the present invention.

FIGS. 31-36 illustrate another embodiment of a partition top anchor 640. The partition top anchor 640 includes a rod member 648 and a key member 660. The rod member 648 is configured to be disposed in the slip tube 42 embedded in the partition or masonry wall 14, as described above with reference to rod member 48. The key member 660 is configured to be disposed in the keyway channel 70 embedded in the overlying deck or slab 18, as described above with reference to key member 60. The key member 660 has a generally dovetail shape.

Figure 31:
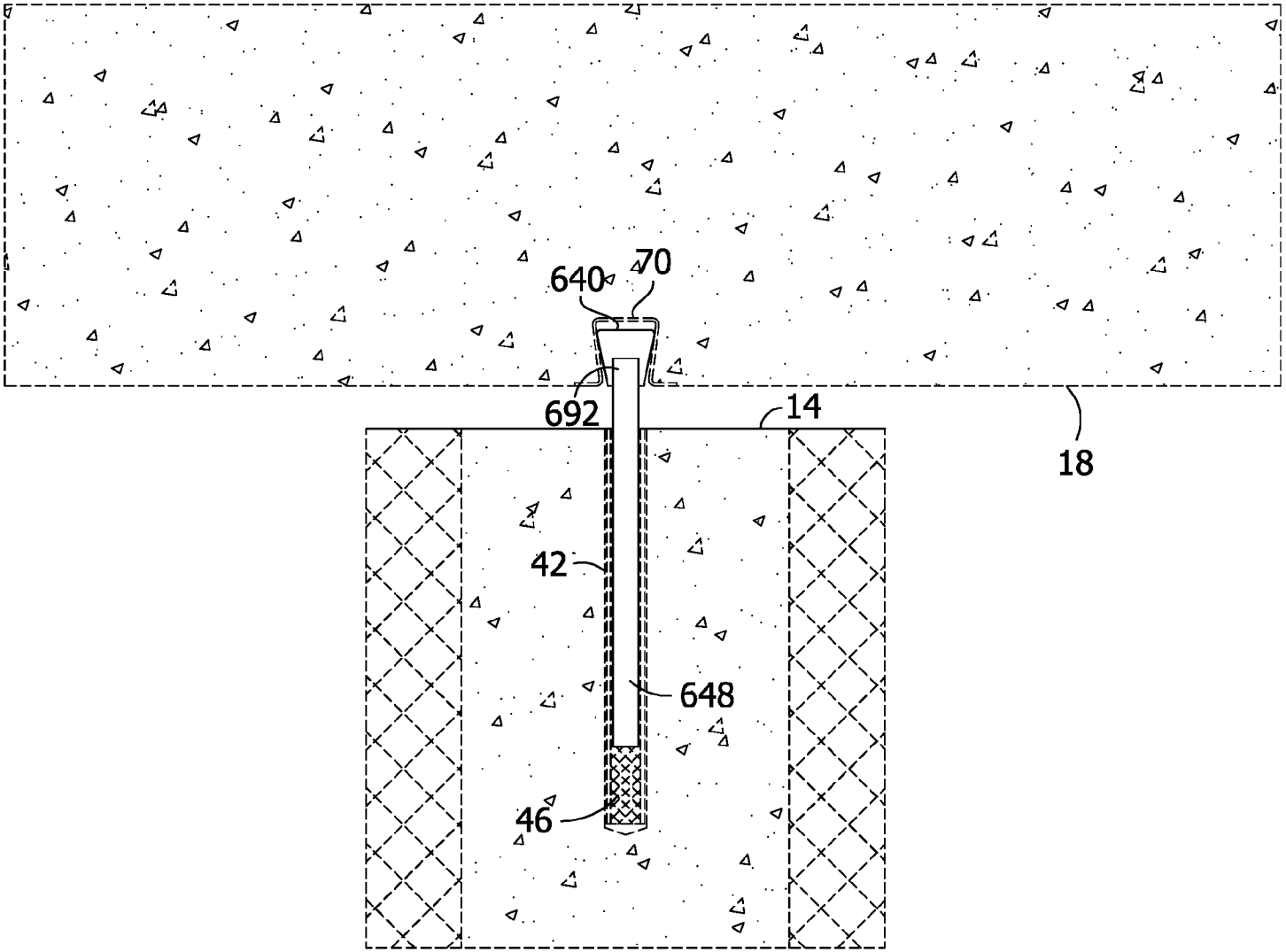
FIG. 31 is a partial cross section of a building structure anchored to an overlying slab by a partition top anchor having a transition portion positioned in a keyway channel embedded in the overlying slab.
Figure 32:
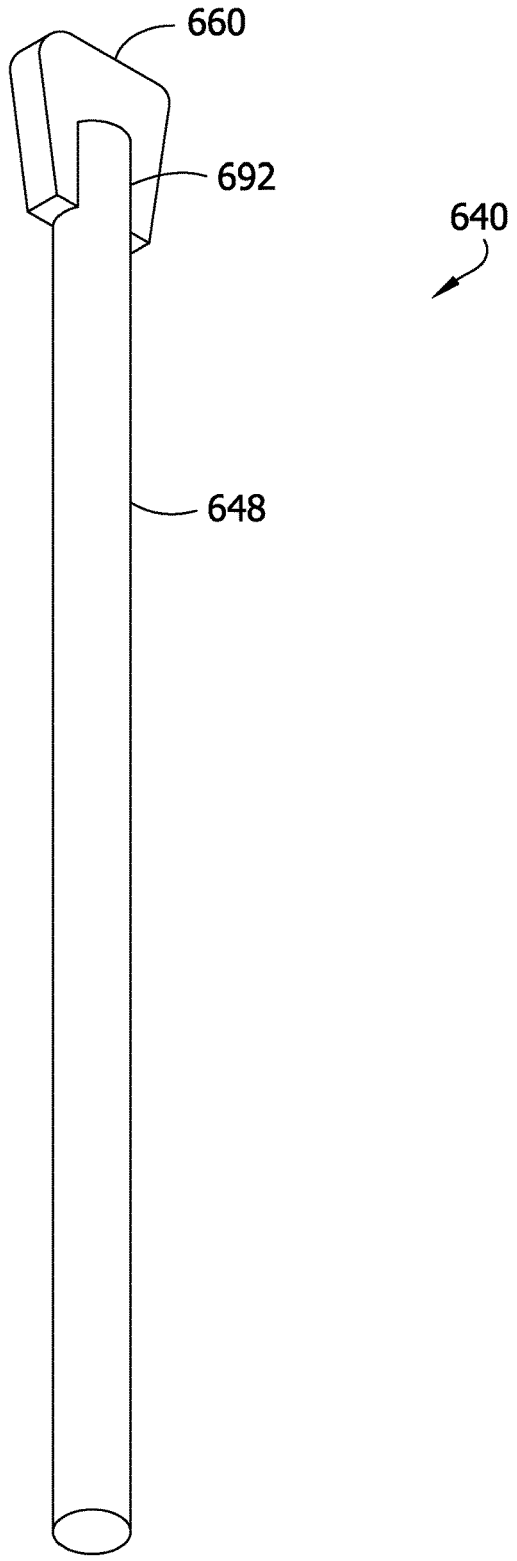
FIG. 32 is a perspective of the partition top anchor of FIG. 31.
Figure 33:
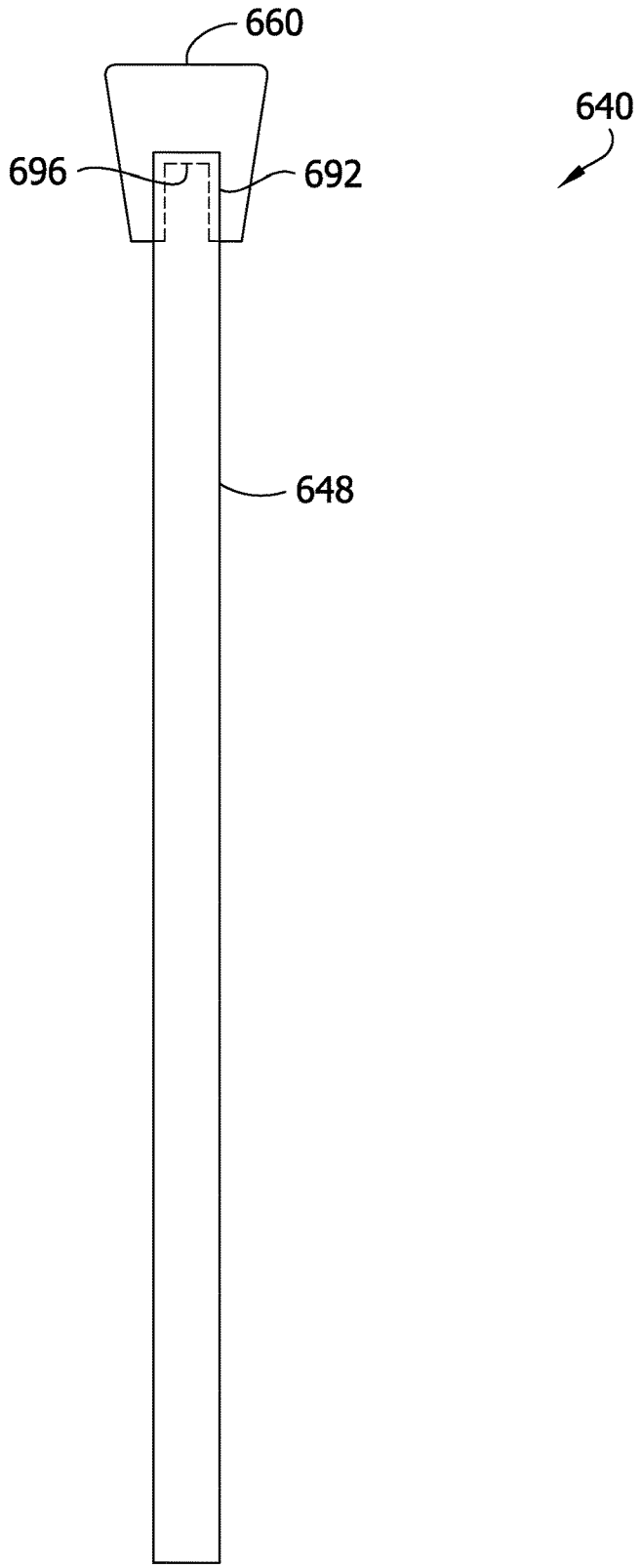
FIG. 33 is a front elevation thereof, illustrating a recess in a key member of the anchor in phantom.
Figure 34:
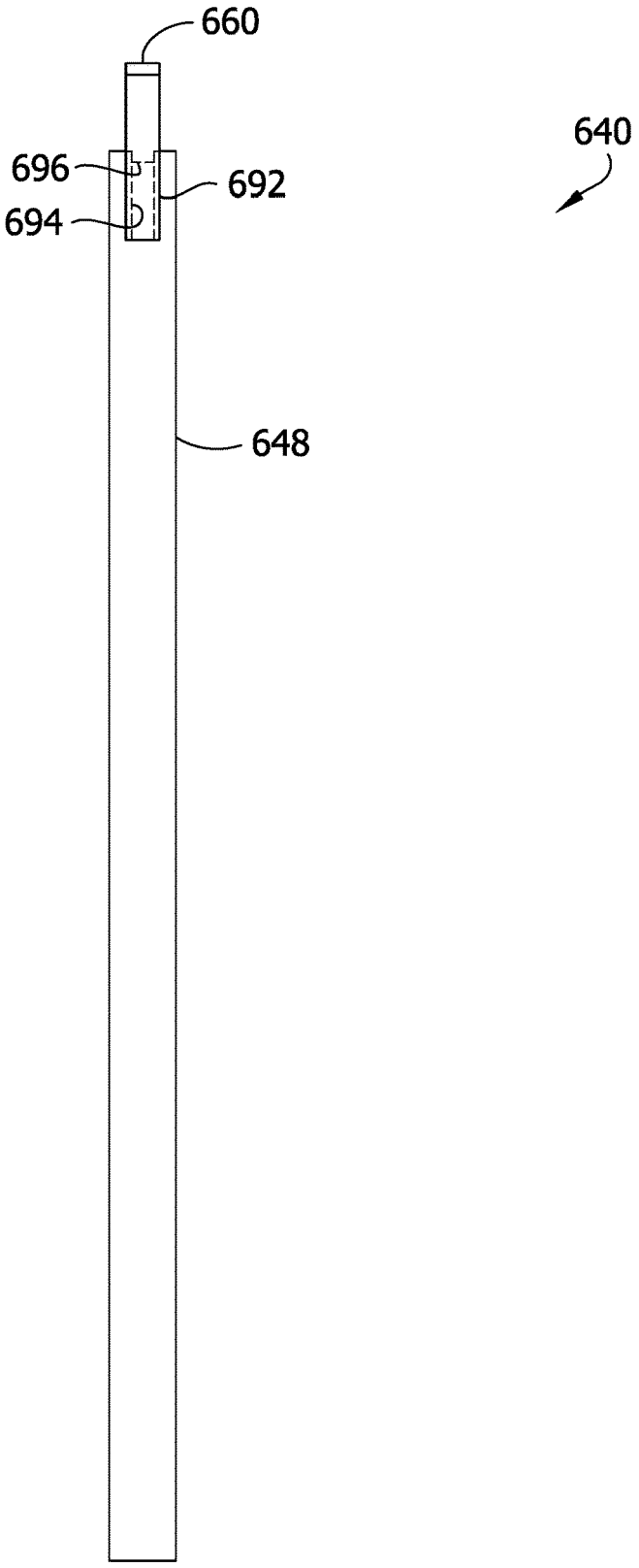
FIG. 34 is a side elevation thereof.
Figure 35:
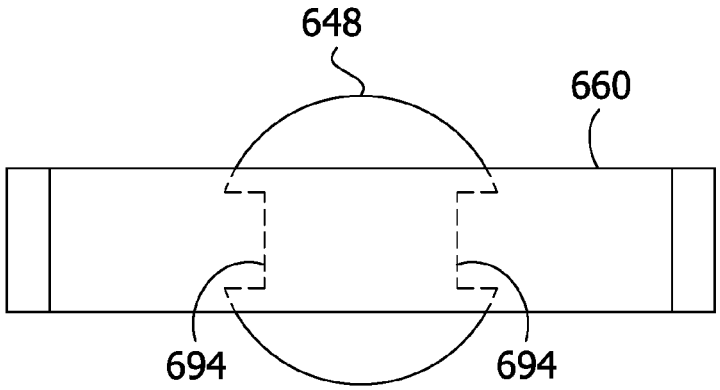
FIG. 35 is a top plan of the partition top anchor of FIG. 31, illustrating notches in a transition portion of the anchor in phantom.
Figure 36:
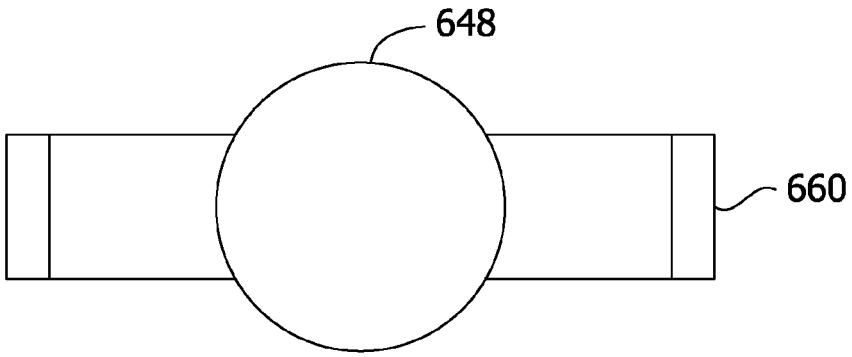
FIG. 36 is a bottom plan thereof.
Figure 37:
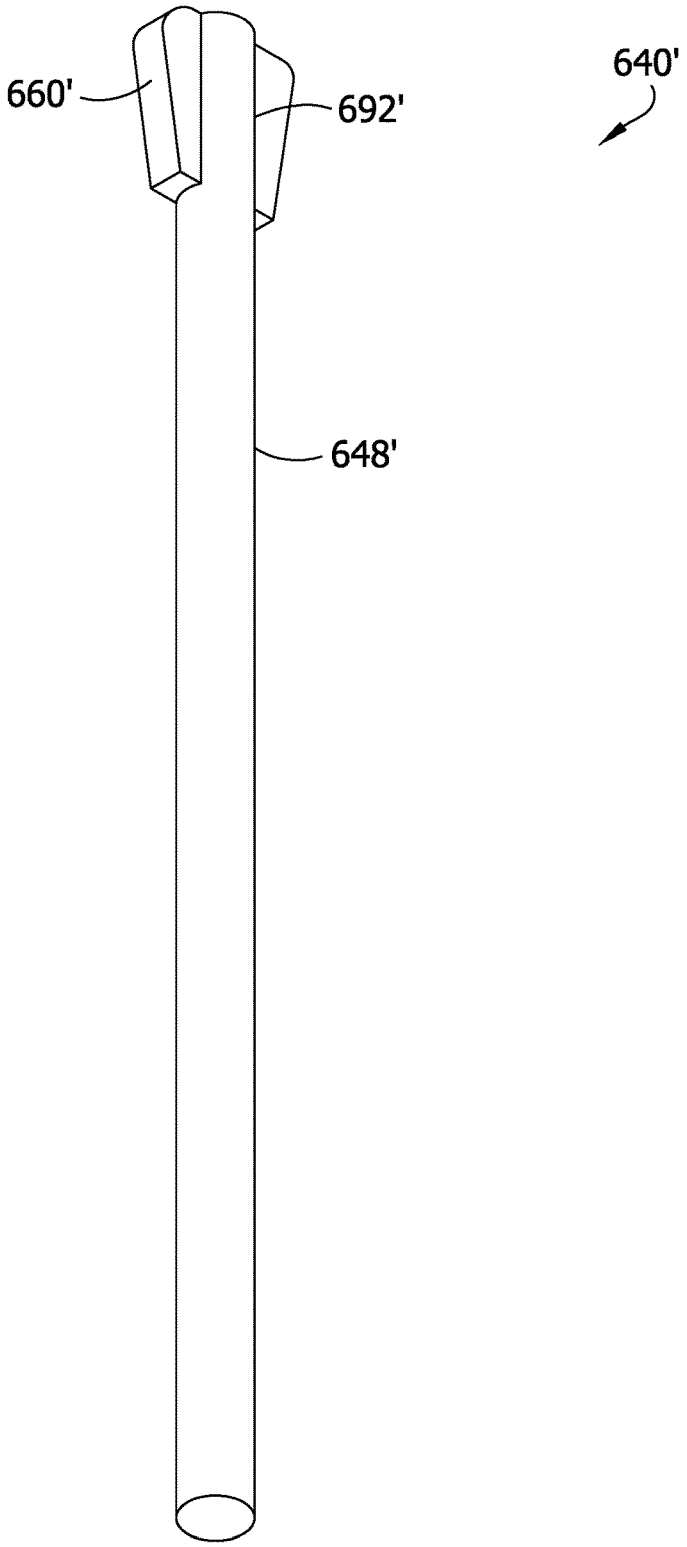
FIG. 37 is a perspective of a partition top anchor including an extended transition portion.
Figure 38:
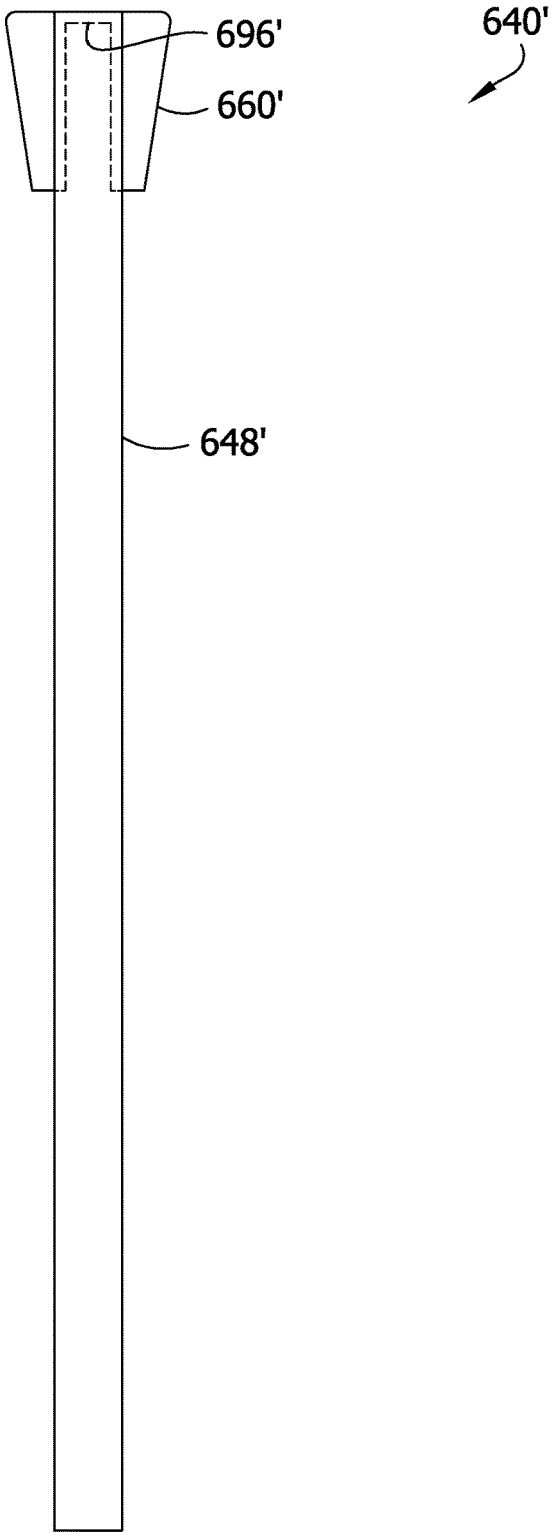
FIG. 38 is a front elevation thereof.
Figure 39:
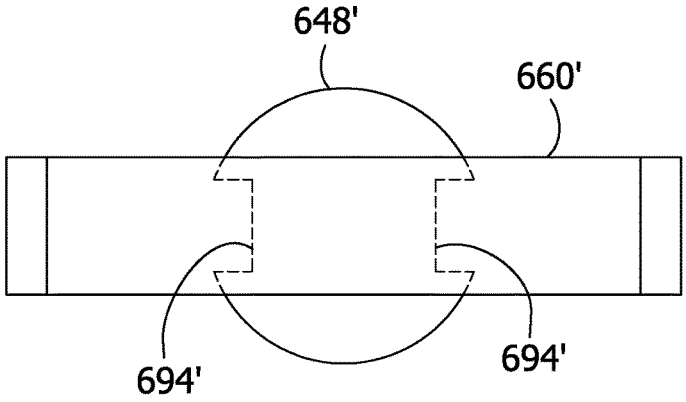
FIG. 39 is a top plan thereof.
Figure 40:
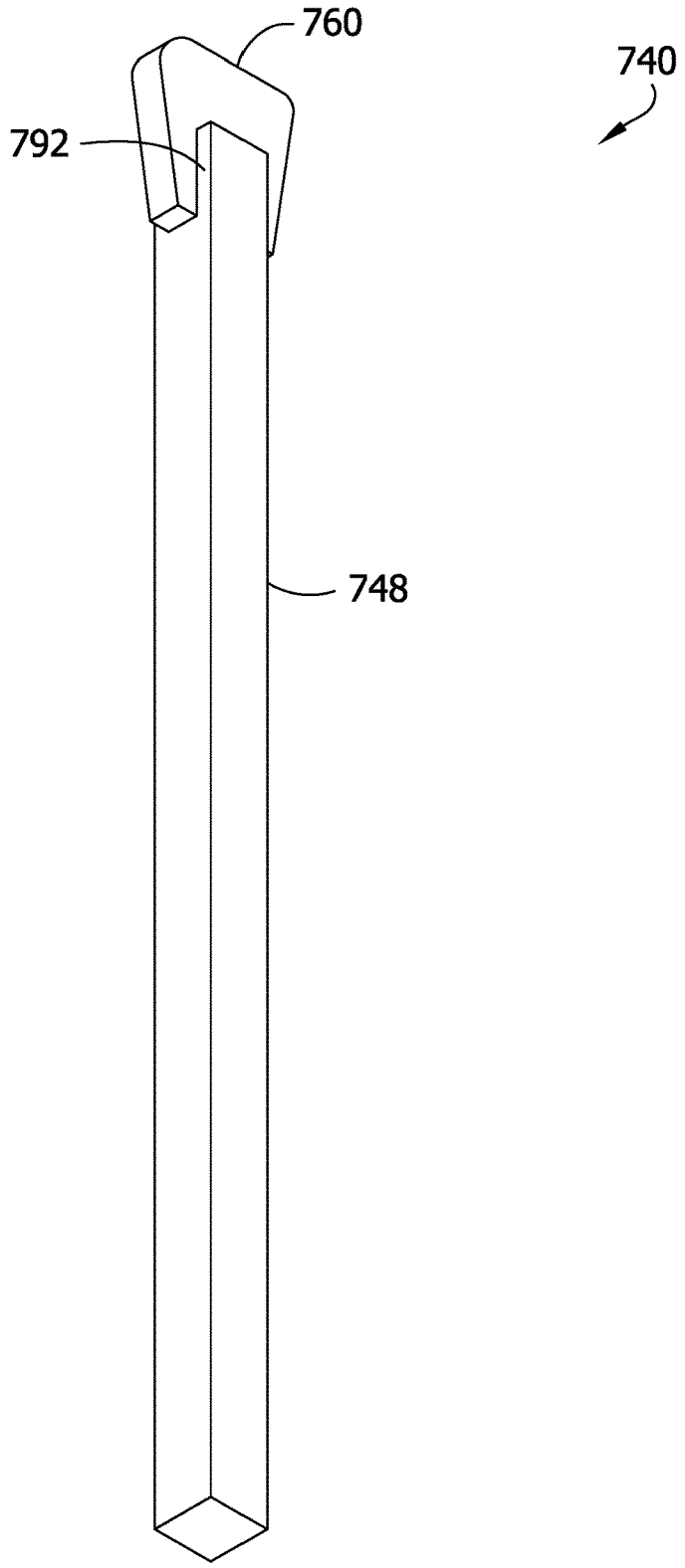
FIG. 40 is a perspective of a partition top anchor including a square rod member.
Figure 41:
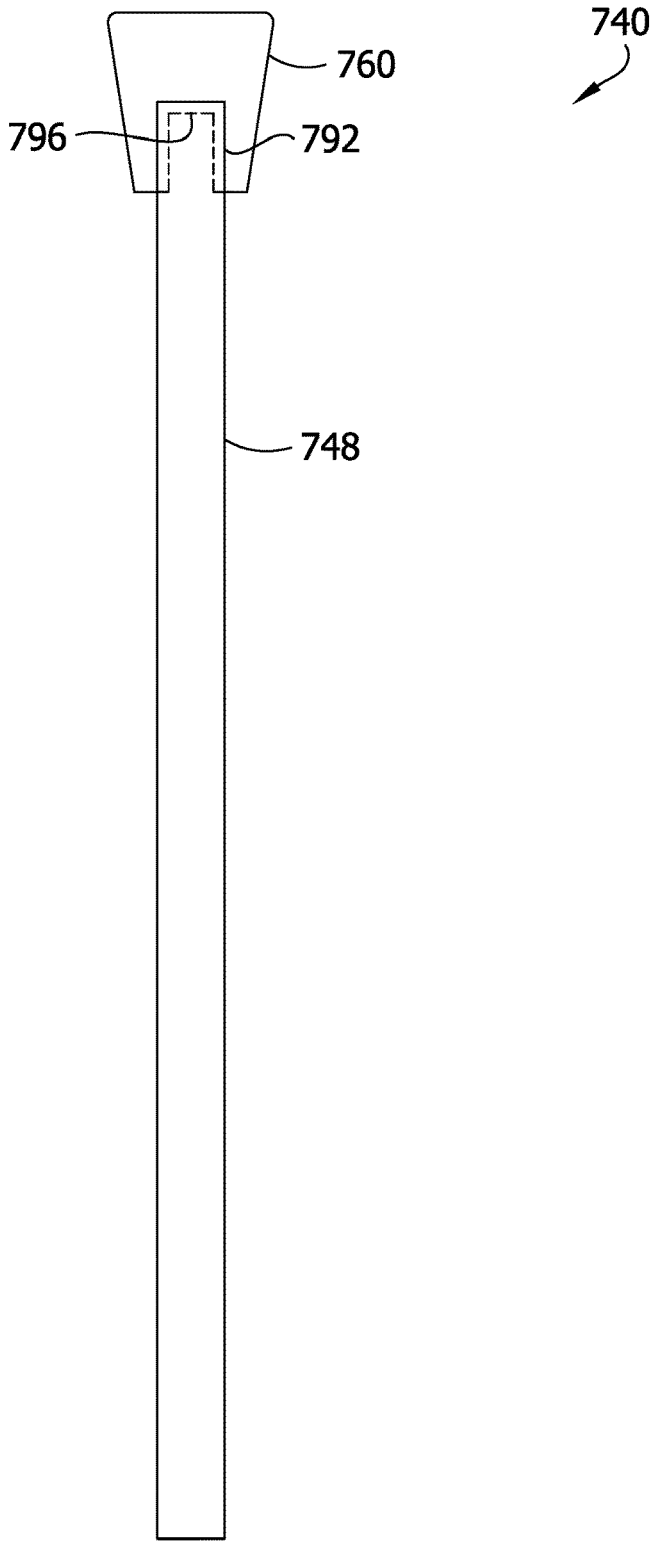
FIG. 41 is a front elevation thereof.
Figure 42:
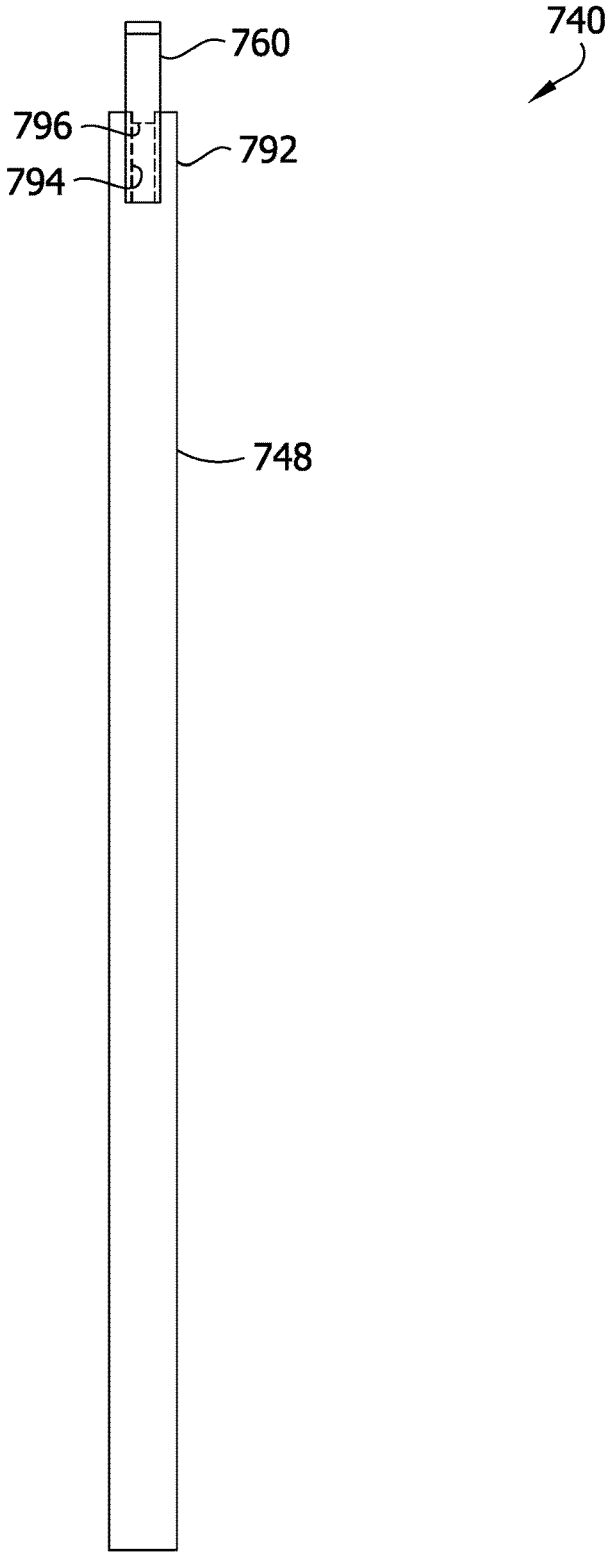
FIG. 42 is a side elevation thereof.
Figure 43:
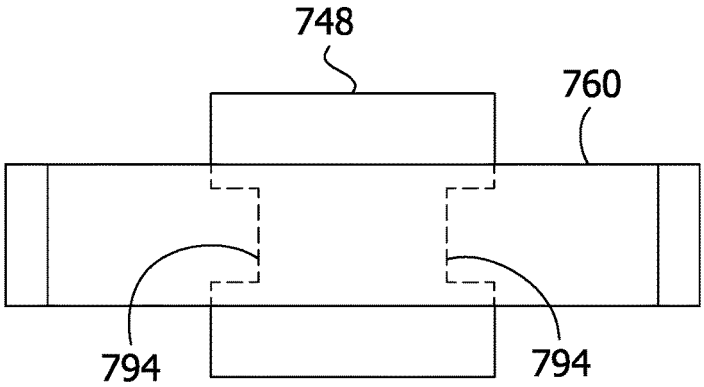
FIG. 43 is a top plan thereof.
Figure 44:
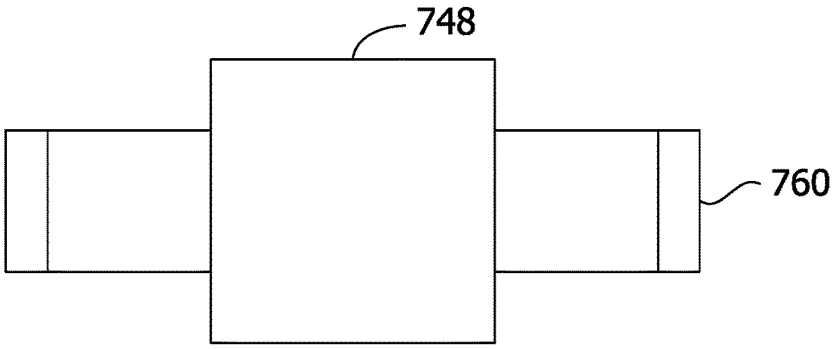
FIG. 44 is a bottom plan thereof.

The anchor 640 includes a transition portion 692 between the key member 660 and the rod member 648. The transition portion 692 is located between the key member 660 and the rod member 648. Referring to FIGS. 34 and 35, the transition portion 692 includes notches 694. The key member 660 includes a recess 696. The key member 660 and rod member 648 are attached in mating engagement such that part of the transition portion 692 is received in the recess 696 of the key member 660, and part of the key member is received in the notches 694 of the transition portion. The key member 660 and rod member 648 may be attached in any suitable manner, such as by press fit, welding, adhesive, or other suitable attachment. The key member 660 can be cast. The rod member 648 can be a length of bar stock that is notched at one end. As illustrated, the rod member 648 can be a length of round bar stock. Alternatively, the key member and the rod member can be cast as one piece of material. As seen in FIG. 31, at least part of the transition portion 692 of the anchor 640 is received in the keyway channel 70 when the anchor is in use. Preferably, the entire transition portion 692 (including the notches 694 and the recess 696) is received in the keyway channel 70 when the anchor 640 is in use. FIG. 37 illustrates an anchor 640' including an extended transition portion 692'. The transition portion 692' extends approximately the full length of the key member 660'. The transition portion 692' includes notches 694' and the key member 660' includes a recess 696' configured for mating engagement with the notches.

Figure 45:
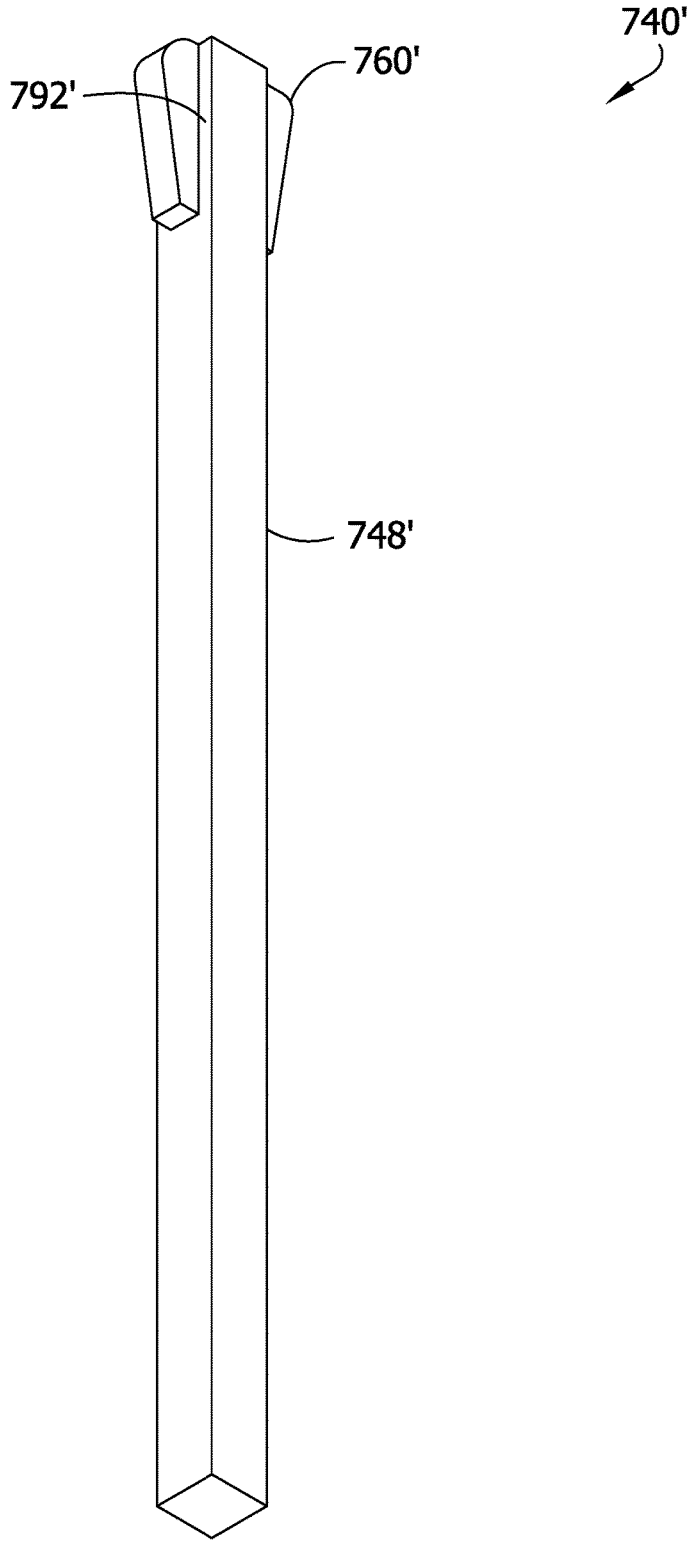
FIG. 45 is a perspective of a partition top anchor including a square rod member and an extended transition portion.
Figure 46:
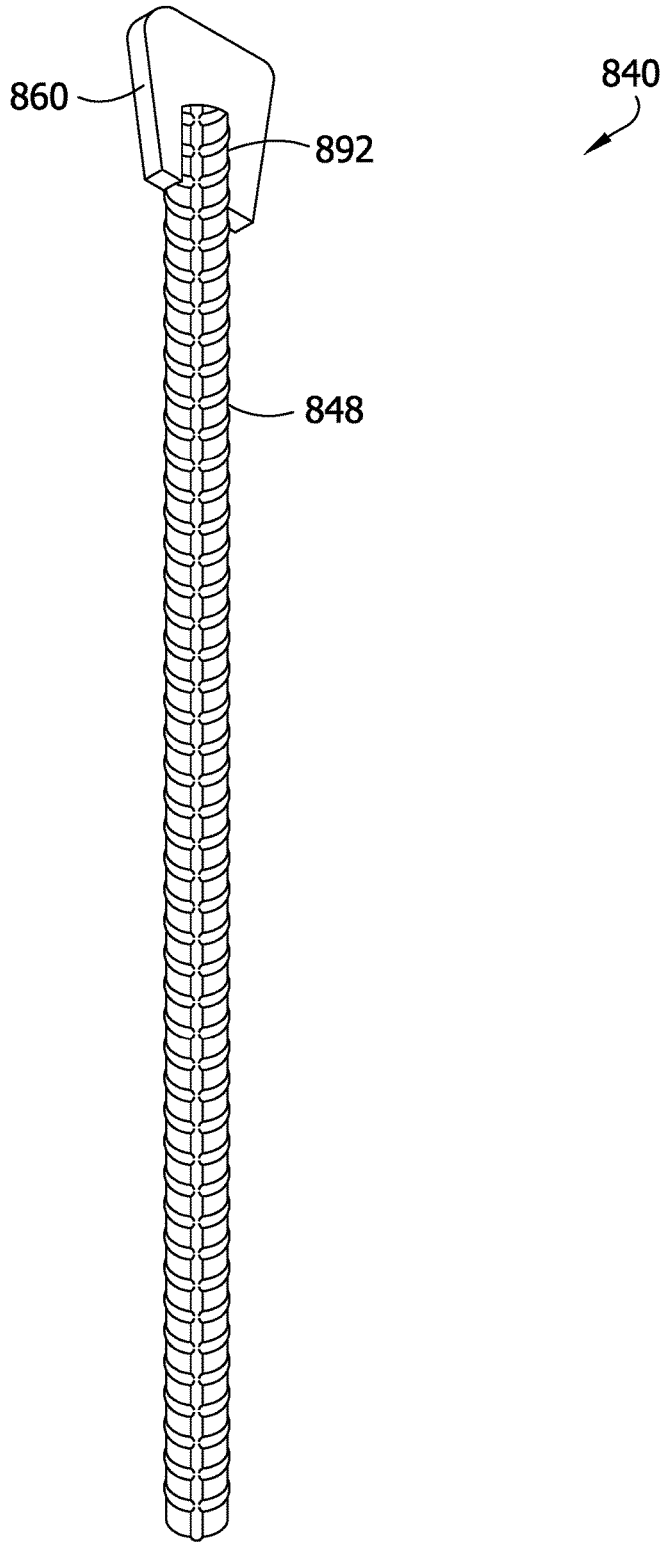
FIG. 46 is a perspective of a partition top anchor including a rebar rod member.
Figure 47:
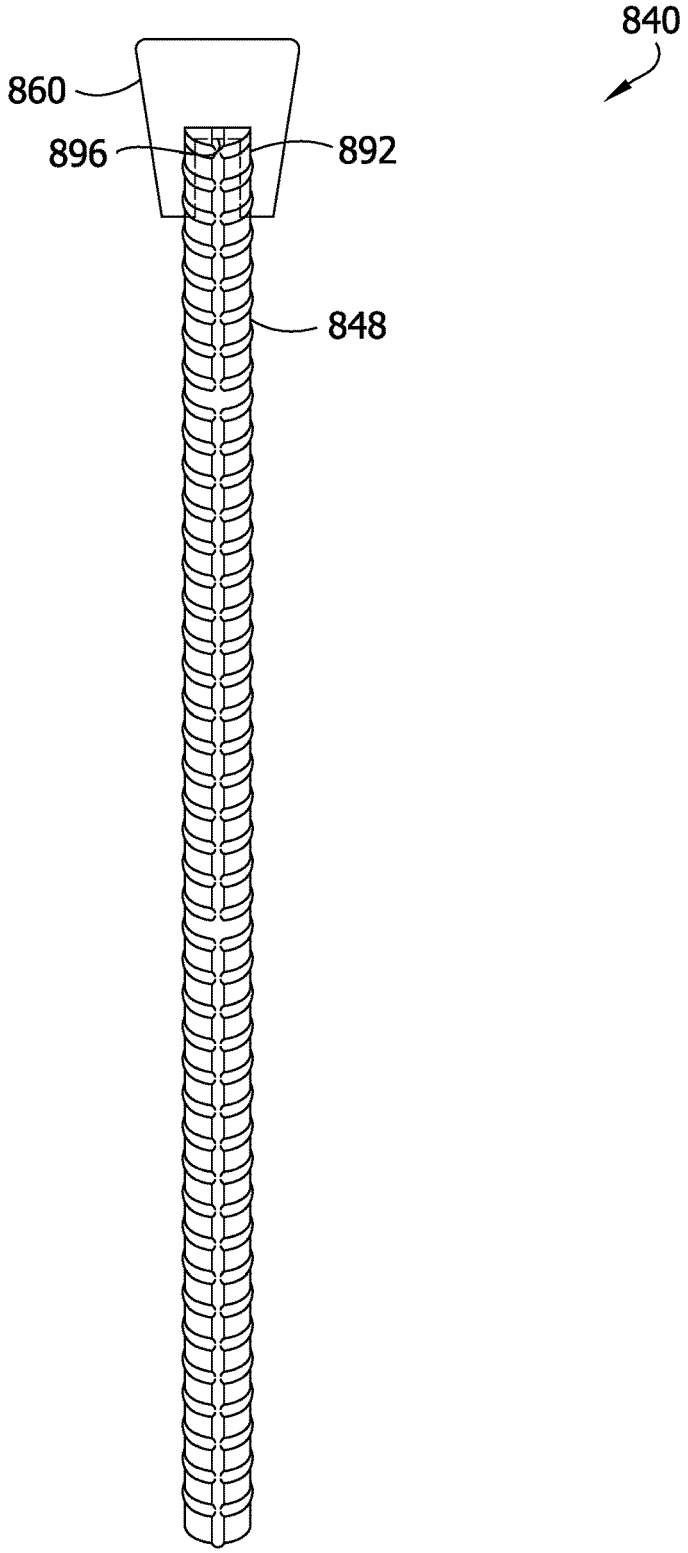
FIG. 47 is a front elevation thereof.
Figure 48:
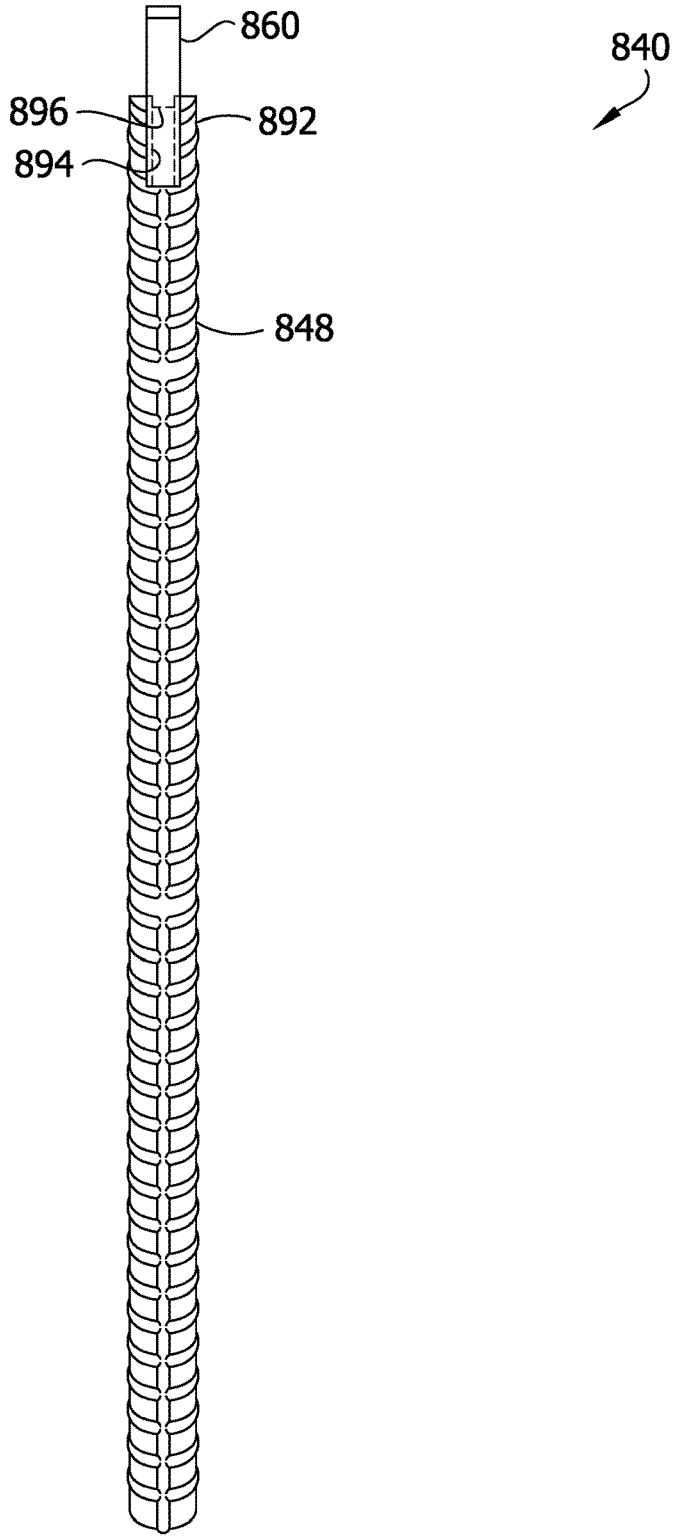
FIG. 48 is a side elevation thereof.
Figure 49:
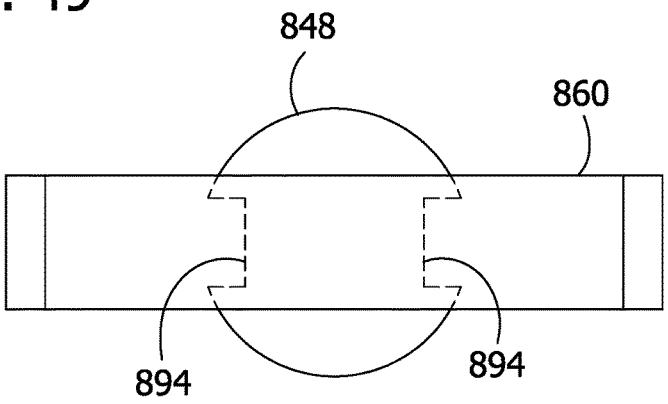
FIG. 49 is a top plan thereof.

FIGS. 40-44 illustrate additional embodiments of the partition top anchor. In FIGS. 40-44, a partition top anchor 740 includes a rod member 748, a key member 760, and a transition portion 792. The rod member 748 comprises a length of square bar stock. The transition portion 792 includes notches 794. The key member 760 includes a recess 796 configured for mating engagement with the notches 794 of the transition portion 792. FIG. 45 illustrates an anchor 740' including an extended transition portion 792'. The transition portion 792' extends approximately the full length of the key member 760'.

Figure 50:
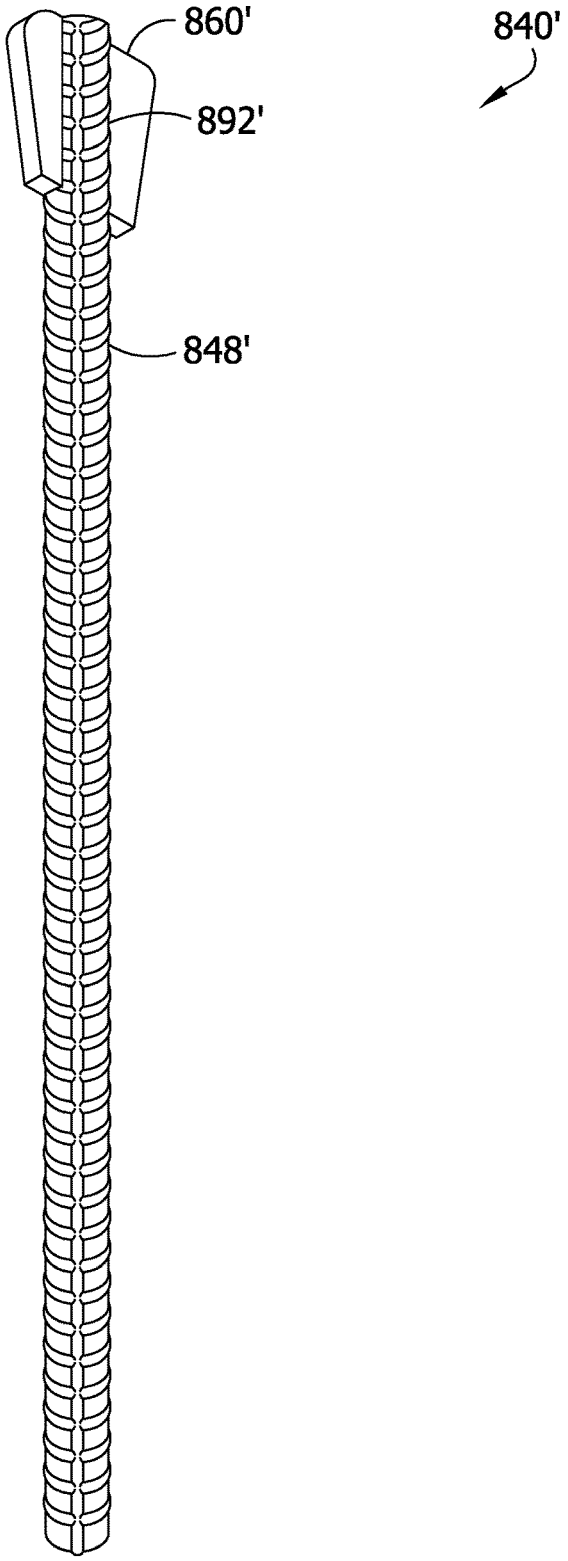
FIG. 50 is a perspective of a partition top anchor including a rebar rod member and an extended transition portion.
Figure 51:
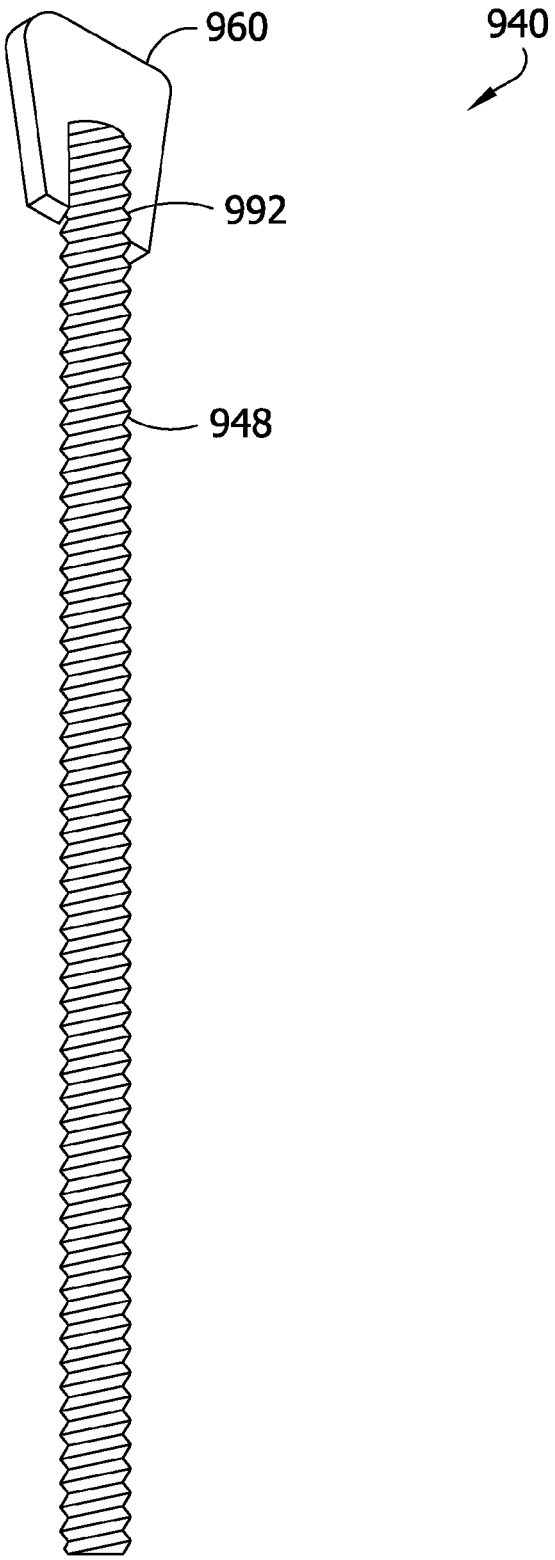
FIG. 51 is a perspective of a partition top anchor including a threaded rod member.
Figure 52:
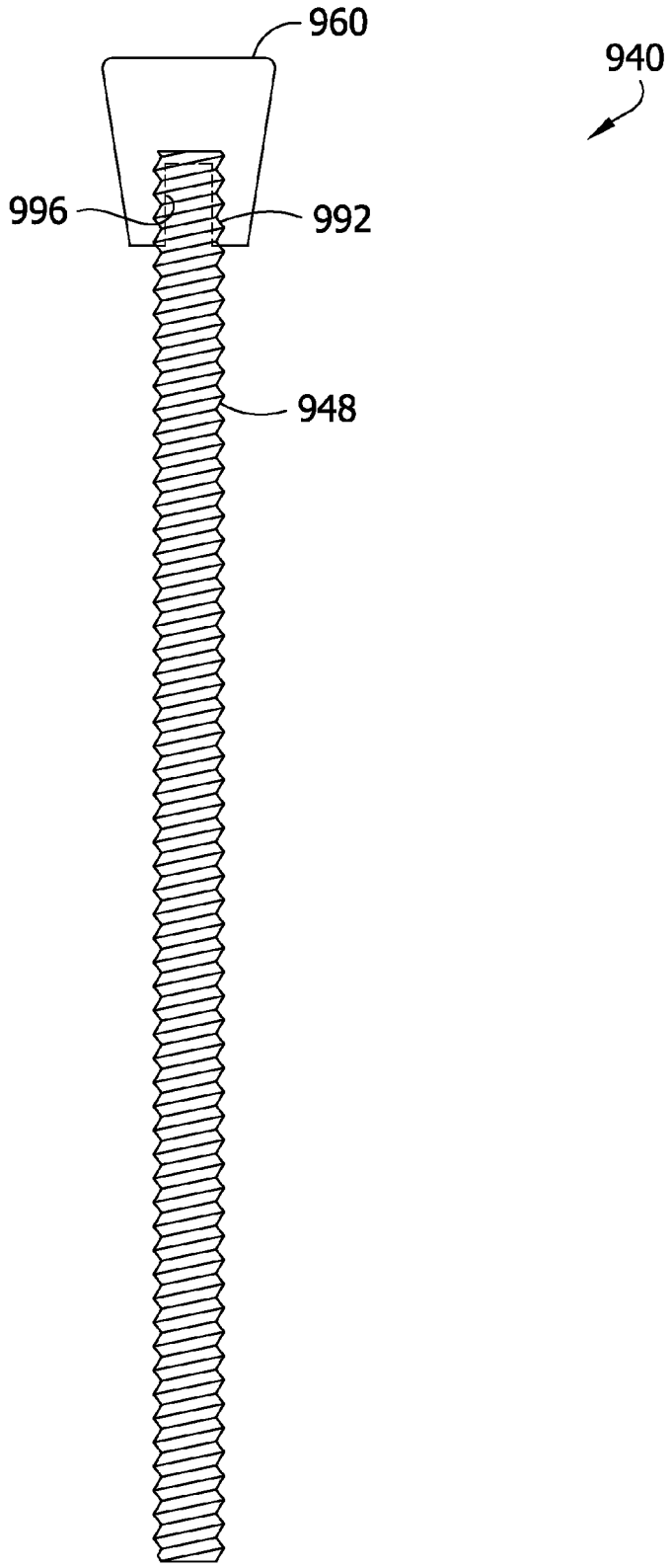
FIG. 52 is a front elevation thereof.
Figure 53:
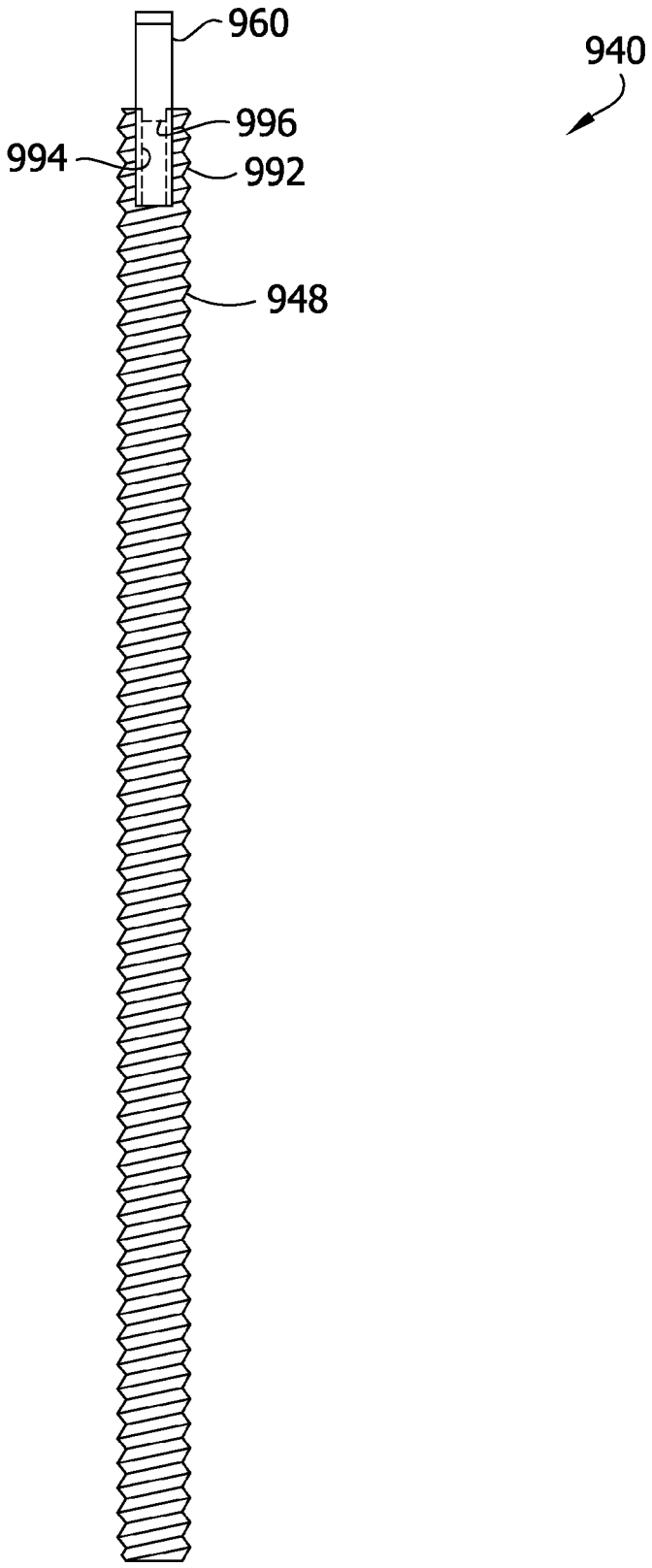
FIG. 53 is a side elevation thereof.
Figure 54:
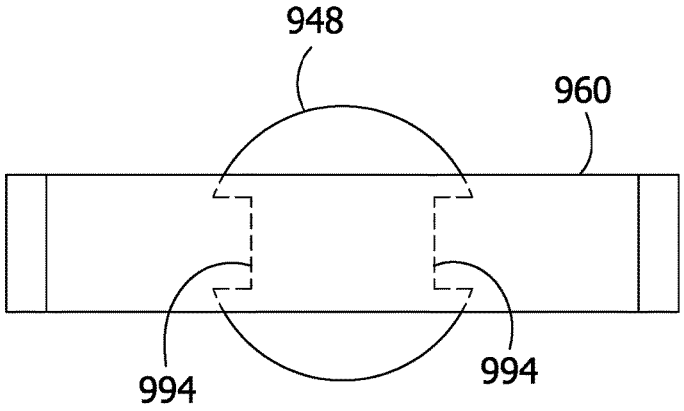
FIG. 54 is a top plan thereof.

In FIGS. 46-49, a partition top anchor 840 includes a rod member 848, a key member 860, and a transition portion 892. The rod member 848 comprises a length of rebar. The transition portion 892 includes notches 894. The key member 860 includes a recess 896 configured for mating engagement with the notches 894 of the transition portion 892. FIG. 50 illustrates an anchor 840' including an extended transition portion 892'. The transition portion 892' extends approximately the full length of the key member 860'.

Figure 55:
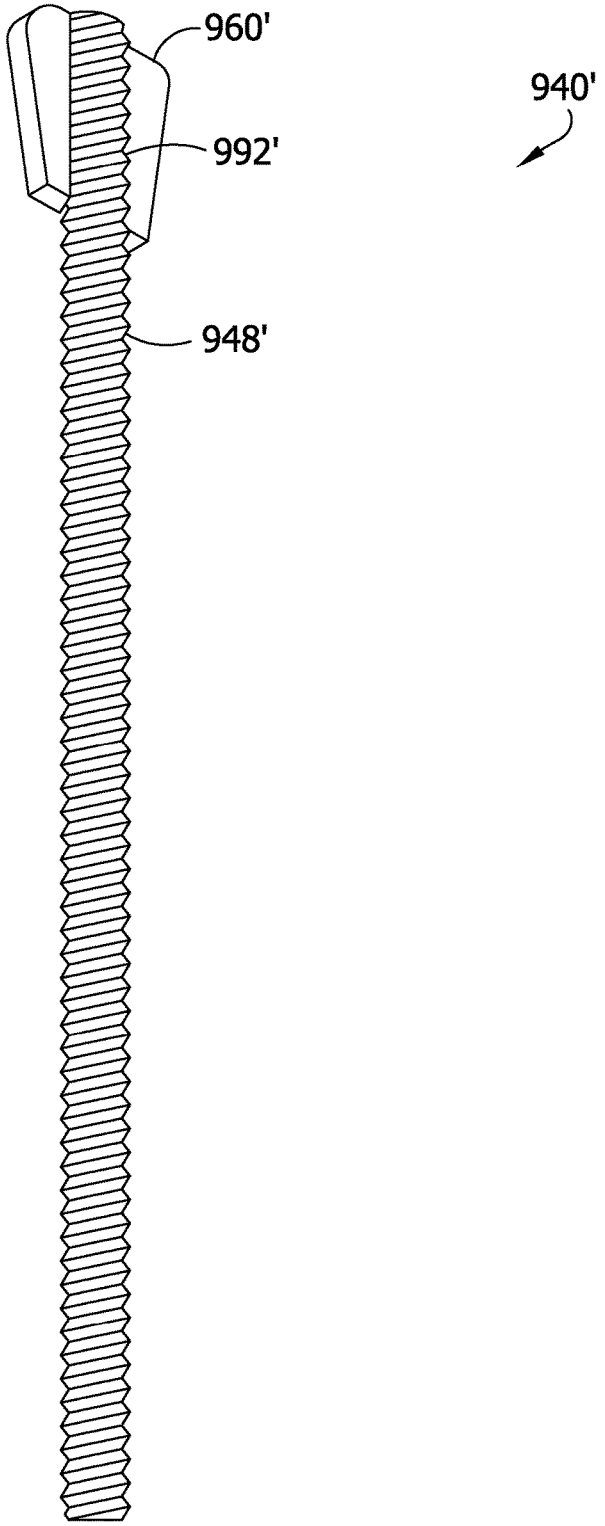
FIG. 55 is a perspective of a partition top anchor including a threaded rod portion and an extended transition portion.

As shown in FIGS. 51-54, a partition top anchor 940 includes a rod member 948, a key member 960, and a transition portion 992. The rod member 948 comprises a length of threaded rod. The transition portion 992 includes notches 994. The key member 960 includes a recess 996 configured for mating engagement with the notches 994 of the transition portion 992. FIG. 55 illustrates an anchor 940' including an extended transition portion 992'. The transition portion 992' extends approximately the full length of the key member 960'.

In each of the embodiments illustrated in FIGS. 31-55, the transition portion of the anchor is at least partially received in the keyway channel 70 when the anchor is in use, and preferably is entirely disposed in the keyway channel during use. As the transition portion begins at a bottom-most location of the key member, preferably the entirety of the key member is positioned in the keyway channel during use of the anchor. It is understood that any of the anchors as described above can be formed as one piece of material (e.g., forged, cast, etc.).

The partition top anchors as described above offer a stronger connection between the overlying deck 18 and the masonry wall 14. The transition portion between the key member and the rod member of each anchor is configured to be positioned partially or entirely within the keyway channel 70 embedded in the overlying deck 18. This configuration protects the weakest part of the anchor by embedding the transition in the overlying deck, thereby providing an advantage over prior art anchoring systems where the connection between the key member and the rod is positioned outside the keyway channel and the overlying deck.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength anchoring system for protecting a partition or masonry wall from damage inflicted by lateral forces thereupon and maintaining the relationship between an overlying deck or slab and the adjoining masonry wall, the masonry wall having a proximal end and a distal end with respect to the overlying deck or slab, the anchoring system comprising:

a slip tube embedded in the proximal end of the masonry wall, the slip tube having an open end disposed at the proximal end of the wall and defining a longitudinal axis passing through the open end; and an anchor comprising a rod member at one end of the anchor movably disposed within the slip tube so as to allow the anchor to slide within the slip tube along and in the direction of the longitudinal axis to protect the masonry wall from damage inflicted by lateral forces, a key member having a distal edge and a proximal edge with respect to the rod member and configured for disposition in the overlying deck at another end of the anchor, and a transition portion between the rod member and the key member, the transition portion extending past the proximal edge of the key member toward the distal edge and being configured to be at least partially disposed within the overlying deck.

2. The anchoring system of claim 1, wherein the transition portion between the rod member and the key member is configured to be entirely disposed within the overlying deck.

3. The anchoring system of claim 1, wherein the anchor is formed as one piece of material.

4. The anchoring system of claim 3, wherein the anchor is forged as one piece of material.

5. The anchoring system of claim 3, wherein the anchor is cast as one piece of material.

6. The anchoring system of claim 1, wherein the transition portion tapers from the proximal edge of the key member toward the distal edge of the key member such that the transition portion gets smaller in width as it extends away from the rod member.

7. The anchoring system of claim 1, wherein the key member has opposite, flat surfaces, the transition portion extending over at least one of the opposite, flat surfaces, and wherein the key member tapers toward the rod member in the transition portion.

8. The anchoring system of claim 1, wherein the transition portion comprises at least one notch, the at least one notch receiving a portion of the key member.

9. The anchoring system of claim 1, wherein the key member includes a recess, the recess receiving the transition portion.

10. The anchoring system of claim 1, wherein the key member comprises a dovetail fitting.

11. The anchoring system of claim 1, further comprising a keyway channel embedded in the overlying deck, the keyway channel having a throat opening at an exterior face of the deck.

12. The anchoring system of claim 11, wherein the key member is disposed in the keyway channel, and the transition portion is at least partially disposed within the keyway channel.

13. A high-strength anchoring system for protecting a partition or masonry wall from damage inflicted by lateral forces thereupon and maintaining the relationship between an overlying deck or slab and the adjoining masonry wall, the anchoring system comprising:

a keyway channel embedded in the overlying deck, the keyway channel having a throat opening at an exterior face of the deck;

a slip tube embedded in the masonry wall and having an open end disposed opposite the throat opening of the keyway channel, the slip tube defining a longitudinal axis passing through the open end; and an anchor partially disposed in the keyway channel and partially disposed in the slip tube, the anchor comprising a rod member at one end of the anchor movably disposed in the slip tube so as to allow the anchor to slide in the slip tube along and in the direction of the longitudinal axis to protect the masonry wall from damage inflected by lateral forces, a key member disposed in the keyway channel at an opposite end thereof, and a transition portion between the rod member and the key member, the key member having distal edge and a proximal edge with respect to the rod member, the transition portion extending past the proximal edge of the key member toward the distal edge, wherein the entire transition portion is disposed within the keyway channel.

14. The anchoring system of claim 13, wherein the anchor is formed as one piece of material.

15. The anchoring system of claim 14, wherein the anchor is forged as one piece of material.

16. The anchoring system of claim 14, wherein the anchor is cast as one piece of material.

17. The anchoring system of claim 13, wherein the rod member tapers from the proximal edge of the key member toward the distal edge of the key member in the transition portion such that the transition portion gets smaller in width as it extends toward the distal edge of the key member.

18. The anchoring system of claim 13, wherein the key member has opposite, flat surfaces, the transition portion extending over at least one of the opposite, flat surfaces, and wherein the key member tapers toward the rod member in the transition portion.

19. The anchoring system of claim 13, wherein the rod member comprises at least one notch in the transition portion, the at least one notch receiving a portion of the key member.

20. The anchoring system of claim 13, wherein the key member includes a recess in the transition portion, the recess receiving a portion of the rod member.

21. The anchoring system of claim 13 wherein the rod member extends from the transition portion away from the overlying deck in which the keyway channel is embedded.

* * * * *